US011930865B2

(12) United States Patent
Dillinger

(10) Patent No.: US 11,930,865 B2
(45) Date of Patent: Mar. 19, 2024

(54) GARMENT WITH ZONAL STRETCH WEAVING

(71) Applicant: Levi Strauss & Co., San Francisco, CA (US)

(72) Inventor: Paul Dillinger, San Francisco, CA (US)

(73) Assignee: Levi Strauss & Co., San Francisco, CA (US)

( * ) Notice: Subject to any disclaimer, the term of this patent is extended or adjusted under 35 U.S.C. 154(b) by 460 days.

(21) Appl. No.: 16/726,159

(22) Filed: Dec. 23, 2019

(65) Prior Publication Data

US 2020/0196684 A1 Jun. 25, 2020

Related U.S. Application Data

(60) Provisional application No. 62/784,150, filed on Dec. 21, 2018.

(51) Int. Cl.
*A41D 1/06* (2006.01)

(52) U.S. Cl.
CPC ..... *A41D 1/06* (2013.01); *A41D 2500/20* (2013.01)

(58) Field of Classification Search
CPC ..... A41D 1/06; A41D 2500/20
USPC ..... 2/79
See application file for complete search history.

(56) References Cited

U.S. PATENT DOCUMENTS 5,447,462 A 9/1995 Smith et al.
5,535,451 A 7/1996 Tassone et al.
5,537,690 A 7/1996 Johnson
5,762,535 A 6/1998 Nishiyama et al.
5,765,224 A 6/1998 Johnson
5,888,118 A 3/1999 Kishi
5,968,597 A 10/1999 Vogt et al.
6,035,448 A 3/2000 Thomson
6,238,266 B1 5/2001 Vogt
6,645,040 B2 11/2003 Rabinowicz et al.
6,837,771 B2 1/2005 Falla
7,159,621 B2 1/2007 Shannon
7,341,500 B2 3/2008 Horn et al.
7,682,219 B2 3/2010 Falla
7,690,965 B2 4/2010 Falla et al.
7,950,069 B2 5/2011 Lee
8,418,268 B2 4/2013 Waldman et al.
(Continued)

FOREIGN PATENT DOCUMENTS

JP 6033909 U 5/1994
JP 7028904 U 5/1995
(Continued)

OTHER PUBLICATIONS

International Search Report, PCT Application No. PCT/US2019/068441, dated Apr. 7, 2020, 3 pages.

*Primary Examiner* — Alissa J Tompkins
*Assistant Examiner* — Catherine M Ferreira
(74) *Attorney, Agent, or Firm* — Aka Chan LLP

(57) ABSTRACT

A garment is made from a material woven to have multiple stretch characteristics. The garment can be jeans and the material can be a denim. Enhanced stretch denim shaping performance is achieved through engineered placement of weave-integrated hold zones and extension zones. The hold yarns and extension yarns will have distinct stretch performance attributes, but typically have the same or similar gauge, shrinkage, tensile strength, and durability.

7 Claims, 16 Drawing Sheets

(56) References Cited

U.S. PATENT DOCUMENTS

| | | | | |
|---|---|---|---|---|
| 8,621,670 | B2 | 1/2014 | Hansen | |
| 8,732,865 | B2 | 5/2014 | Ishikawa et al. | |
| 8,806,765 | B2 | 8/2014 | Tulin | |
| 8,984,668 | B2 | 3/2015 | Tulin et al. | |
| D735,478 | S | 8/2015 | Tulin | |
| 9,668,525 | B2 | 6/2017 | Boyle et al. | |
| 2004/0111781 | A1 | 6/2004 | Miyake et al. | |
| 2007/0214541 | A1 | 9/2007 | Kawasaki et al. | |
| 2008/0034476 | A1 | 2/2008 | MacKinnon | |
| 2009/0181599 | A1 | 7/2009 | Farmer et al. | |
| 2010/0192284 | A1* | 8/2010 | Simon | A41D 1/06 2/243.1 |
| 2010/0288434 | A1 | 11/2010 | Falla | |
| 2010/0297912 | A1 | 11/2010 | Falla | |
| 2011/0003533 | A1 | 1/2011 | Caruso et al. | |
| 2011/0083246 | A1 | 4/2011 | Vitarana | |
| 2011/0214216 | A1 | 9/2011 | Zarabi | |
| 2011/0230121 | A1 | 9/2011 | Fong | |
| 2011/0302686 | A1 | 12/2011 | Chapius | |
| 2012/0084987 | A1 | 4/2012 | Tulin | |
| 2012/0129425 | A1 | 5/2012 | Bevans | |
| 2013/0095730 | A1 | 4/2013 | Jensen | |
| 2014/0053312 | A1 | 2/2014 | Nordstrom et al. | |
| 2014/0068836 | A1* | 3/2014 | Tulin | A41D 1/06 2/243.1 |
| 2014/0165265 | A1 | 6/2014 | Tulin et al. | |
| 2015/0196068 | A1 | 7/2015 | Tulin et al. | |
| 2016/0120246 | A1* | 5/2016 | Boyle | A41D 1/06 2/227 |
| 2017/0233904 | A1* | 8/2017 | Weening | D03D 13/00 139/420 R |

FOREIGN PATENT DOCUMENTS

| | | | |
|---|---|---|---|
| JP | 9031712 | A | 2/1997 |
| JP | 9296305 | A | 11/1997 |
| JP | 2936070 | | 6/1999 |
| JP | 3085783 | | 2/2002 |
| JP | 3097750 | | 8/2003 |
| JP | 3123137 | | 8/2003 |
| JP | 2003-535235 | | 11/2003 |
| JP | 3792204 | B2 | 6/2006 |
| JP | 4526226 | B2 | 7/2006 |
| JP | 2009-057660 | A | 3/2009 |
| JP | 2009-511764 | A | 3/2009 |
| JP | 2009-114589 | | 5/2009 |
| JP | 2009-235630 | | 10/2009 |
| JP | 2010-042097 | A | 2/2010 |
| JP | 2010-095803 | | 4/2010 |
| JP | 2011-001671 | | 1/2011 |
| JP | 4861073 | B2 | 1/2012 |
| WO | 9958007 | A1 | 11/1999 |
| WO | WO2011136066 | | 11/2011 |
| WO | WO20170091414 | | 6/2017 |

* cited by examiner

GARMENT WITH ZONAL STRETCH WEAVING

CROSS-REFERENCE TO RELATED APPLICATIONS

This patent application claims the benefit of U.S. patent application 62/784,150, filed Dec. 21, 2018, which is incorporated by reference along with all other references cited in this application.

BACKGROUND OF THE INVENTION

The present invention relates to clothing sizing systems and, more specifically, to pants, especially jeans, having a body shaping fit that actively shapes the wearer's body.

In 1853, during the California Gold Rush, Levi Strauss, a 24-year-old German immigrant, left New York for San Francisco with a small supply of dry goods with the intention of opening a branch of his brother's New York dry goods business. Shortly after arriving in San Francisco, Mr. Strauss realized that the miners and prospectors (called the "forty niners") needed pants strong enough to last through the hard work conditions they endured. So, Mr. Strauss developed the now familiar jeans which he sold to the miners. The company he founded, Levi Strauss & Co., still sells jeans and is the most widely known jeans brand in the world. Levi's is a trademark of Levi Strauss & Co.

Though jeans at the time of the Gold Rush were used as work clothes (which were relatively loose fitting since fashion was not a concern), jeans have evolved to be fashionably worn everyday by men and women, showing up on billboards, television commercials, and fashion runways. Fashion is one of the largest consumer industries in the U.S. and around the world. Jeans and related apparel are a significant segment of the industry.

As fashion, people want their jeans to have a customized fit (e.g., "tight fitting jeans"). Good fitting jeans today have a form fit that is very different than, for example, the pants of the 1800s and early 1900s. Before, loose-fit or overly baggy pants and balloon dresses were the norm, since they were intended to hide or obscure the body shape. Today, modern technology has allowed the manufacture of off-the-rack pants, jeans, and shorts having much better form fit, while at the same time being comfortable to wear.

Despite the widespread success jeans have enjoyed, there is a continuing desire to address the demands of the consumer even better. Consumers desire off-the-rack, form-fitting jeans for their own seat and hip shapes, without having to pay for custom tailoring. Existing jeans sizing systems, which may have addressed the market demand of the time they were developed, do not adequately address the demand of the modern consumer and their wide variety of body shapes.

People want their jeans to have a tight, form fitting look, where the jeans conform to the shape of the body. Furthermore, consumers want form flattering jeans that molds and shapes the body's natural silhouette, while flattering the body's natural curves.

Therefore, there is a need for an improved system and technique of making body shaping apparel including jeans and other clothing (e.g., jackets, tops, pants, khaki's, shorts, skirts, T-shirts, lingerie, athleisure wear, sports wear, and others) that provide consumers with apparel that make them look good.

BRIEF SUMMARY OF THE INVENTION

A garment is made from a material woven to have multiple stretch characteristics. The garment can be jeans and the material can be a denim. Enhanced stretch denim shaping performance is achieved through engineered placement of weave-integrated hold zones and extension zones. The hold yarns and extension yarns will have distinct stretch performance attributes, but typically have the same or similar gauge, shrinkage, tensile strength, and durability.

A technical method achieves distinct zones of differentiated stretch performance properties in a contiguously woven length of fabric without apparent visible distinction between the performance zones when worn. These zones are engineered for specific shapewear placement, so that when cut and sewn into a garment they create a hold effect around, for example, the thigh, leg, and stomach—and an extension effect across the posterior.

Contiguous Woven Performance Zones are achieved: The intentional placement of two types of stretch yarns in the warp with differentiated extension and recovery stretch properties—creating distinct hold zones with less elongation and greater compression, and extension zones with more elongation and less compression.

Engineered Zone Placement: The engineered placement and repeat of these performance zones along the length of the fabric's selvage or edge, enabling the garment pattern to be placed and cut to achieve the precise positioning of the extension zone across the back seat or buttocks region of the garment.

Smooth-Transition Blend Zones: A blend zone woven with a variegated alternating placement of hold and extension yarns, creating a smoothly blended gradation between the two distinct stretch performance zones without puckering, rippling, or other visible indications of the transition.

The technology can be used with multiple denim qualities with different constructions, weights, and fiber compositions. The technology can be applied to nondenim fabrications, including twill, sateen, canvas or other plain-weave and other constructions.

In an implementation, a pair of pants includes a denim material (e.g., twill weave) sewn into pants, where the denim material has multiple woven stretch characteristics. A first zone of the denim material has hold yarns. A second zone has extension yarns. A third zone has alternating groupings of hold and extension yarns. The hold yarns are stretch yarns with higher relative lateral tension force. The extension yarns are stretch yarns with lower relative lateral tension force. The extension yarns have a greater stretch characteristic than the hold yarns.

In various implementations, the third zone is positioned between the first zone and second zone. The alternating groupings of hold and extension yarns in third zone can be organized as 1 extension yarn, then 6 hold yarns, then 2 extension yarns, then 5 hold yarns, then 3 extension yarns, then 4 hold yarns, 4 extension yarns, 3 hold yarns, 5 extension yarns, 2 hold yarns, 6 extension yarns, and 1 hold yarn.

The second zone can be positioned at a seat or buttocks region of the pants. The second zone can be positioned at a knee cap region of the pants, which can be in combination with the second positioning at the seat or buttocks region of the pants.

A differential in stretch between first zone and second zone can range from about 10 percent to about 15 percent. A differential in stretch between first zone and second zone can range from about 7 percent to about 15 percent. A differential in stretch between first zone and second zone can range from about 7 percent to about 10 percent.

The denim material can be a contiguous weave including the first zone, second zone, and third zone. The third zone can be positioned between the first zone and second zone, including alternating groupings of hold and extension yarns in third zone of 1 extension yarn, then 6 hold yarns, then 2 extension yarns, then 5 hold yarns, then 3 extension yarns, then 4 hold yarns, 4 extension yarns, 3 hold yarns, 5 extension yarns, 2 hold yarns, 6 extension yarns, and 1 hold yarn.

In an implementation, a pair of pants includes a panel of contiguously woven fabric sewn into the pants. The panel includes a first portion having a first stretch characteristic, a second portion having a second stretch characteristic, and a third portion having a third stretch characteristic. The first, second, third stretch characteristics are different from each other. The different stretch characteristics are achieved without an additional material being coupled to the panel.

For example, there is not a polyurethane coating applied to the panel. There is not an elastic material, padding, or other material stitched to or otherwise joined or layered onto the panel. And the panel is not a patchwork of smaller pieces of different fabric or materials sewn, glued fused, or otherwise joined together.

The first portion of the panel is positioned at a seat or buttocks region of the pants. The second portion is below the buttocks region. The first stretch characteristic has greater stretch than the second stretch characteristic. The third portion is between the first and second portions. The third stretch characteristic is a blending of the first and second stretch characteristics.

In various implementations, the third stretch characteristic of the third portion provides a transition from first stretch characteristic to the second stretch characteristic. The first portion includes a weave with a first yarn type that provides the first stretch characteristic. The second portion includes a weave with a second yarn type that provides the second stretch characteristic. The third portion includes a weave with first and second yarn types that provides the third stretch characteristic.

The third portion includes a weave of variegated alternating placement of the first yarn type and the second yarn type. The weave creates a smoothly blended gradation between the two distinct stretch performance zones of the first and second portions, without puckering, rippling, or other visible indications of a transition.

In an implementation, a pair of pants includes a panel of contiguously woven fabric sewn into the pants. The panel includes a first region including a first yarn having a first stretch characteristic, a second region including a second yarn having a second stretch characteristic, and a third region including a blend of the first yarn and the second yarn.

The first region of the panel is positioned at an extension location of the pants. The second region is below the extension location. The first stretch characteristic is greater than the second stretch characteristic. The third region is between the first and second regions. The third region smoothly transitions from the first region to the second region to avoid forming of an abrupt transition edge.

In various implementations, the third region avoids a visible indication from an exterior of the pants of a transition between the first region and the second region. The first yarn includes a first percentage of elastane. The second yarn includes a second percentage of elastane. The second percentage of elastane is greater than the first percentage of elastane.

A back pocket of the pants includes a first pocket portion made from a material including the first yarn and a second pocket portion is made from a material including a blend of the first yarn and the second yarn. A crotch point of the pants can be positioned at a point on an edge of where the first region meets the third region of the panel.

In an implementation, a method includes: providing a first panel of contiguously woven fabric for pants, where the first panel includes a first region including a first yarn having a first stretch characteristic, a second region including a second yarn having a second stretch characteristic, and a third region including a blend of the first yarn and the second yarn; positioning the first region of the first panel at an extension location of the pants; positioning the second region below the extension location, where the first stretch characteristic is greater than the second stretch characteristic; positioning the third portion between the first and second regions, where the third portion smoothly transitions from the first region to the second region to avoid forming of an abrupt transition edge; and positioning a crotch point of the pants along at a point along an edge wherein the first region meets the third region of the first panel.

In various implementations, the extension location is at a buttocks region of the pants. The extension location is at a knee cap region of the pants. The blend of the first yarn and the second yarn in the third region is made by weaving 1 first yarn, then 6 second yarns, then 2 first yarns, then 5 second yarns, then 3 first yarns, then 4 second yarns, 4 first yarns, 3 second yarns, 5 first yarns, 2 second yarns, 6 first yarns, and 1 second yarn.

The method can include providing a second panel for a back pocket of the pants, where the second panel has a first pocket region including the second yarn having the second stretch characteristic, and a second pocket region including a blend of the first yarn and the second yarn; and positioning a first portion of a rolled hem of the back pocket in the first pocket region and a second portion of the rolled hem of the back pocket in the second pocket region.

The contiguously woven fabric for pants can include warp yarns that contiguously weave through weft yarns of the first region, second region, and third region. For the first yarn, the yarn used for the first yarn can have a first percentage of elastane. The yarn used for the second yarn can have a second percentage of elastane. The second percentage is greater than the first percentage.

The first stretch characteristic includes more elongation and less compression relative to the second stretch characteristic. The second stretch characteristic includes less elongation and greater compression relative to the first stretch characteristic.

Other objects, features, and advantages of the present invention will become apparent upon consideration of the following detailed description and the accompanying drawings, in which like reference designations represent like features throughout the figures.

DETAILED DESCRIPTION OF THE INVENTION

Many people have difficulty finding form fitting jeans that flatter their body shape and help define their silhouette. Form fitting jeans can actually appear to be too tight in some areas, and too loose in others. A problem with tight jeans is that they do not offer support for the wearer's body to hold in and smooth out certain areas that need added support. Consumers generally indicate these problematic areas to be the stomach, hips, seat, and thighs. After repeated wear, what were once tight-fitting jeans can noticeably begin to stretch, sag, and wear in the fabric around these areas of the body. As a result, the jeans can actually emphasize flawed areas of the body rather than flattering the natural curves and shape of the wearer. Some jeans manufacturers have not taken into consideration the need to provide increased support for these body areas.

To address these shortcomings, a new system and technique of manufacturing and creating body shaping apparel uses a fabric or material with multiple stretch characteristics, and in particular, zonal woven stretch. The apparel can include garments including for example, pants, shorts, active wear, underwear, and shape wear. Although the system is discussed with respect to pants, jeans, capris, and shorts, the system can also be applied to other types of shaped fit clothing, such as those worn, at least in part, at and below the waist. These include skorts (combination of shorts and a skirt), slacks, formal wear (e.g., tuxedo trousers), school uniforms, military wear, athletic wear, sportswear (e.g., cycling wear, ski wear, golf wear, martial arts wear, track and field wear, swim wear, gymnastics wear, softball uniforms, baseball uniforms, football uniforms, hockey uniforms, lacrosse uniforms, winter and summer Olympics team apparel, gym wear, and others), dance wear, lingerie, panties, boxers, briefs, corsets, costumes (e.g., Halloween costumes or masquerade ball), compression wear, tights, socks, and many others.

The shaped fit clothing can also be worn, at least in part, at and above the waist. These include tops, blouses, shirts, tank tops, sweaters, camisoles, dress, crop top, tube top, wrap top, dolman top, peplum top, sweatshirt, hoodie, pullover, swim wear, polos, brassiere or bras, and many others.

Figure 1:
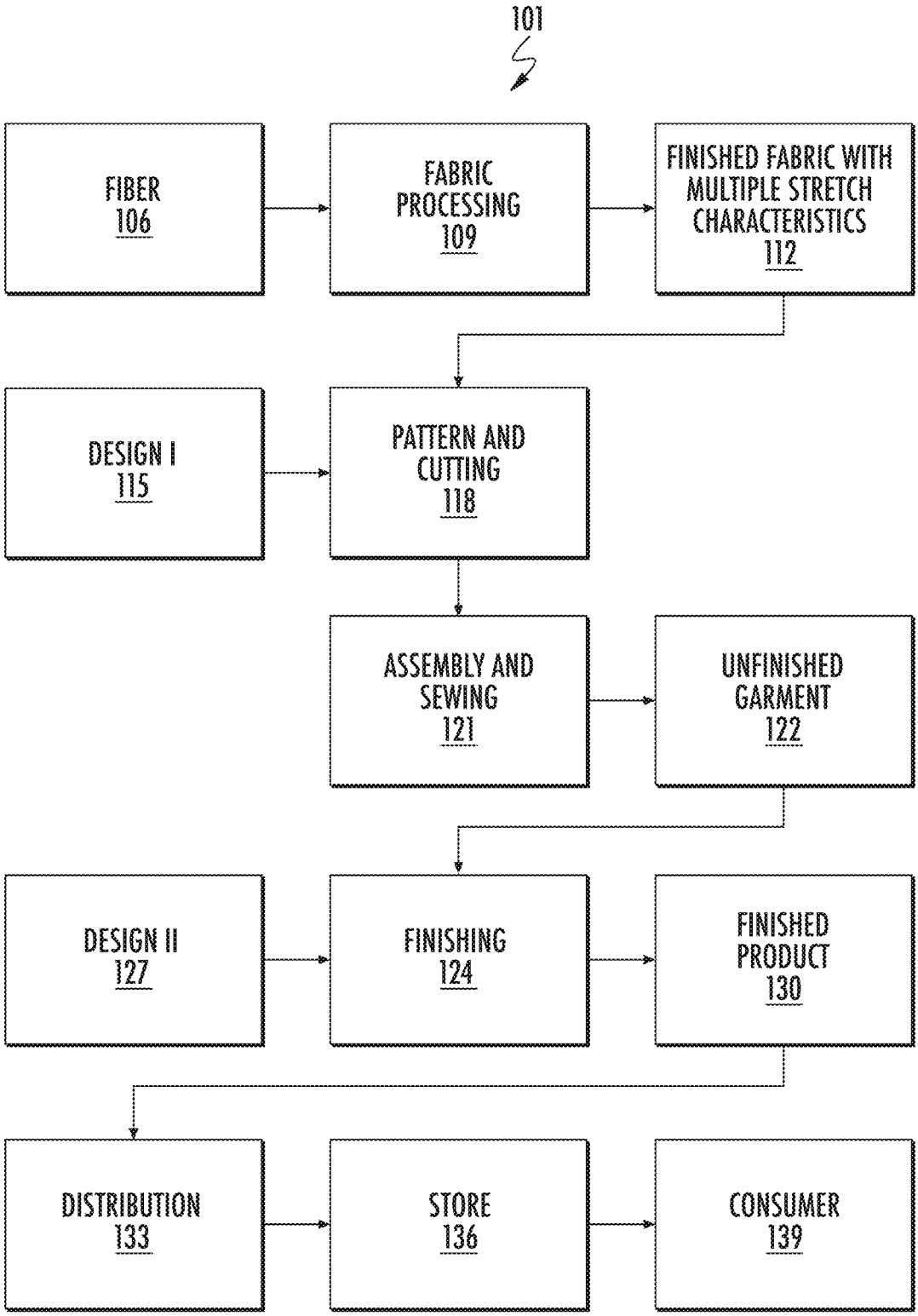
FIG. 1 shows system diagram of manufacturing apparel with multiple stretch characteristics.

FIG. 1 shows a process flow 101 for manufacturing apparel such as jeans, where garments include multiple stretch characteristics. The fabric or material for various apparel including jeans is made from natural or synthetic fibers 106, or a combination of these. A fabric mill takes fibers and processes 109 these fibers to produce a finished fabric 112, which has multiple stretch characteristics.

Some examples of natural fibers include cotton, flax, hemp, sisal, jute, kenaf, and coconut; fibers from animal sources include silk, wool, cashmere, and mohair. Some examples of synthetic fibers include polyester, nylon, spandex or elastane, and other polymers. Some examples of semisynthetic fibers include rayon, viscose, modal, and lyocell, which are made from a regenerated cellulose fiber. A fabric can be a natural fiber alone (e.g., cotton), a synthetic fiber alone (e.g., polyester alone), a blend of natural and synthetic fibers (e.g., cotton and polyester blend, or cotton and spandex), or a blend of natural and semisynthetic fibers, or any combination of these or other fibers.

For jeans, the fabric is typically a denim, which is a sturdy cotton warp-faced textile in which a weft passes under two or more warp threads. This twill weaving produces a diagonal ribbing. The yarns (e.g., warp yarns) are dyed using an indigo or blue dye, which is characteristic of blue jeans.

Although this patent describes the apparel processing and finishing with respect to jeans, the invention is not limited jeans or denim products, such as shirts, shorts, jackets, vests, and skirts. The techniques and approaches described are applicable to other apparel and products, including non-denim products and products made from knit materials. Some examples include T-shirts, sweaters, coats, sweatshirts (e.g., hoodies), casual wear, athletic wear, outerwear, dresses, evening wear, sleepwear, loungewear, underwear, socks, bags, backpacks, uniforms, umbrellas, swimwear, bed sheets, scarves, and many others.

A manufacturer creates a design 115 (design I) of its product. The design can be for a particular type of clothing or garment (e.g., men's or women's jean, or jacket), sizing of the garment (e.g., small, medium, or large, or waist size and inseam length), or other design feature. The design can be specified by a pattern or cut used to form pieces of the pattern. A fabric is selected and patterned and cut 118 based on the design. The pattern pieces are assembled together 121 into the garment, typically by sewing, but can be joined together using other techniques (e.g., rivets, buttons, zipper, hoop and loop, adhesives, or other techniques and structures to join fabrics and materials together).

The design can specify a one or more regions of a garment to have a first stretch characteristic, while other regions have a second stretch characteristic that is different from the first stretch characteristic. For example, the first stretch characteristic can have more stretch or elasticity than the second stretch characteristic.

Some garments can be complete after assembly and ready for sale. However, other garments are unfinished 122 and have additional finishing 124, which can include, for example, laser finishing. The finishing may include tinting, washing, softening, and fixing. For distressed denim products, the finishing can include using a laser to produce a wear pattern according to a design 127 (design II). Some additional details of laser finishing are described in U.S. patent application 62/377,447, filed Aug. 19, 2016, and Ser. No. 15/682,507, filed Aug. 21, 2017, which are incorporated by reference along with all other references cited in this application.

Design 127 is for postassembly aspects of a garment while design 115 is for preassembly aspects of a garment. After finishing, a finished product 130 (e.g., a pair of jeans) is complete and ready for sale. The finished product is inventoried and distributed 133, delivered to stores 136, and sold to consumers or customers 139. The consumer can buy and wear worn blue jeans without having to wear out the jeans themselves, which usually takes significant time and effort.

Traditionally, to produce distressed denim products, finishing techniques include dry abrasion, wet processing, oxidation, or other techniques, or combinations of these, to accelerate wear of the material in order to produce a desired wear pattern. Dry abrasion can include sandblasting or using sandpaper. For example, some portions or localized areas of the fabric are sanded to abrade the fabric surface. Wet processing can include washing in water, washing with oxidizers (e.g., bleach, peroxide, ozone, or potassium permanganate), spraying with oxidizers, washing with abrasives (e.g., pumice, stone, or grit).

These traditional finishing approaches can be used to product garments having multiple stretch characteristics. However, these traditional finishing approaches take time, incur expense, and impact the environment by utilizing resources and producing waste. It is desirable to reduce water and chemical usage, which can include eliminating the use agents such as potassium permanganate and pumice. An alternative to these traditional finishing approaches is laser finishing. Laser finishing approaches can also be used to product garments having multiple stretch characteristics.

Figure 2:
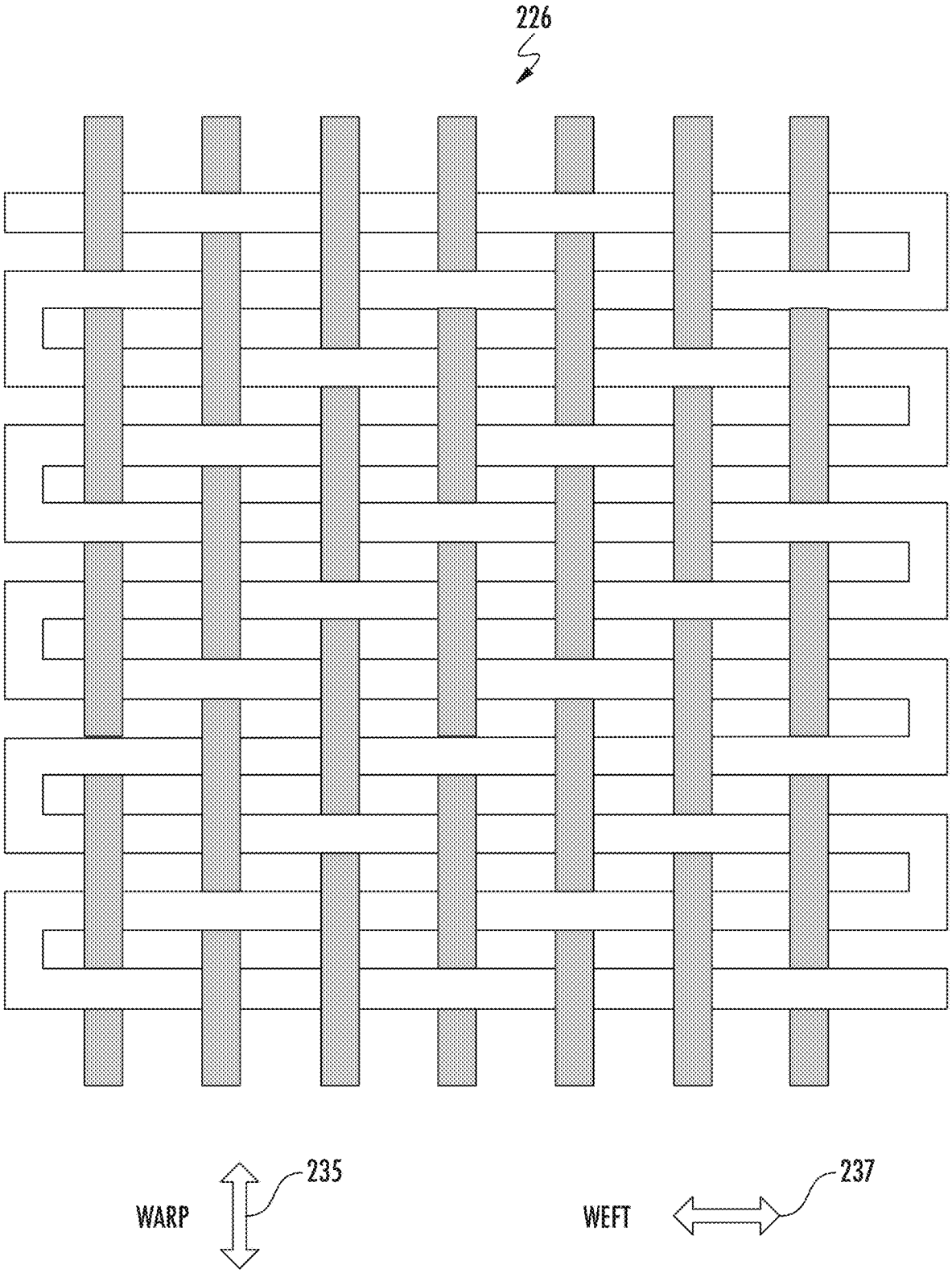
FIG. 2 shows a weave pattern of a denim fabric.

FIG. 2 shows a weave pattern of a denim fabric 226. A loom does the weaving. In weaving, warp is the lengthwise or longitudinal yarn or thread in a roll, while weft or woof is the transverse thread. The weft yarn is drawn through the warp yarns to create the fabric. In FIG. 2, the warps extend in a first direction 235 (e.g., north and south) while the wefts extend in a direction 237 (e.g., east and west). The wefts are shown as a continuous yarn that zigzags across the wefts (e.g., carried across by a shuttle or a rapier of the loom). Alternatively, the wefts could be separate yarns. In some specific implementations, the warp yarn has a different weight or thickness than the weft yarns. For example, warp yarns can be coarser than the weft yarns.

For denim, dyed yarn is used for the warp, and undyed or white yarn is typically used for the weft yarn. In some denim fabrics, the weft yarn can be dyed and have a color other than white, such as red. In the denim weave, the weft passes under two or more warp threads. FIG. 2 shows a weave with the weft passing under two warp threads. Specifically, the fabric weave is known as a 2×1 right-hand twill. For a right-hand twill, a direction of the diagonal is from a lower left to an upper right. For a left-hand twill, a direction of the diagonal is from an lower right to an upper left. But in other denim weaves, the weft can pass under a different number of warp threads, such as 3, 4, 5, 6, 7, 8, or more. In other implementation, the denim is a 3×1 right-hand twill, which means the weft passes under three warp threads.

Because of the weave, one side of the fabric exposes more of the warp yarns (e.g., warp-faced side), while the other side exposes more of the weft yarns (e.g., weft-faced side). When the warp yarns are blue and weft yarns are white, a result of the weave is the warp-faced side will appear mostly blue while the reverse side, weft-faced side, will appear mostly white.

In denim, the warp is typically 100 percent cotton. But some warp yarns can be a blend with, for example, elastane to allow for warp stretch. And some yarns for other fabrics may contain other fibers, such as polyester or elastane as examples.

This patent describes some examples of implementations with specific dimensions, measurements, and values. These are not intended to be exhaustive or to limit the invention to the precise form described. The dimensions or measurements are in inches. The values are approximate values. These values can vary due to, for example, measurement or manufacturing variations or tolerances or other factors. For example, depending on the tightness of the manufacturing tolerances, the values can vary plus or minus 5 percent, plus or minus 10 percent, plus or minus 15 percent, or plus or minus 20 percent.

Further, the measurements are for a specific implementation of a pair of pants or jeans, and other implementations can have different values, such as certain dimensions made larger for a larger-sized product, or smaller for a smaller-sized product. For examples, pants have different waist sizes, different inseam lengths, and different fits (e.g., slim fit and relaxed fit). The pants may be made proportionally larger or smaller by adjusting relative measurements proportionally (e.g., maintaining the same or about the same ratio between different measurements). In various implementations, the values can be the same as the value given, about the same of the value given, at least or greater than the value given, or can be at most or less than the value given, or any combination of these.

Figure 3:
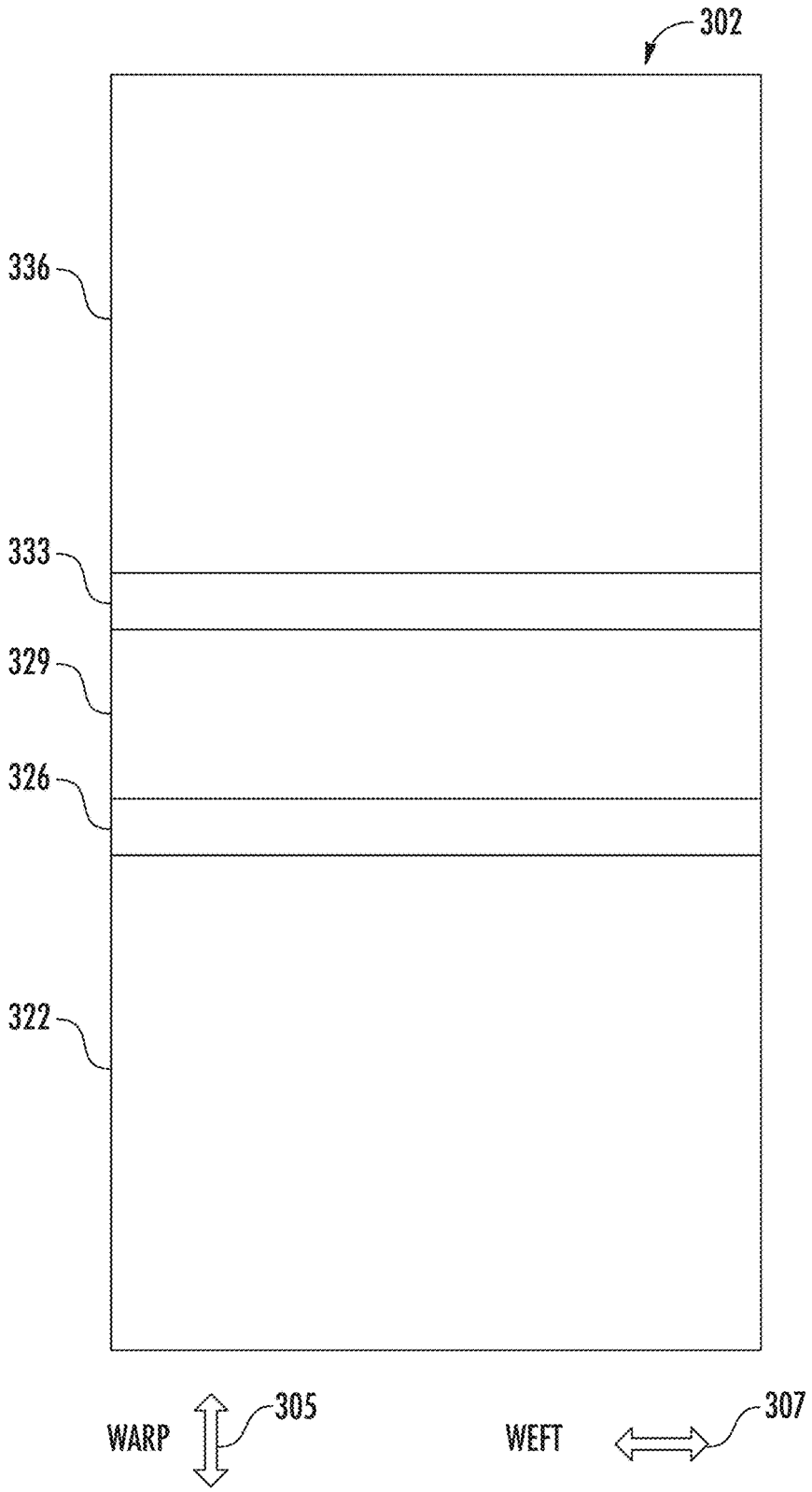
FIG. 3 shows a fabric with multiple stretch characteristics.

FIG. 3 shows a fabric 302 with multiple stretch characteristics. The warp yarns are in a direction 305, and the weft yarns are in a direction 307. There are regions or zones where the weft yarn has different stretch characteristics. There is a hold zone 322, blend zone 326, extension or stretch zone 329, blend zone 333, and hold zone 336.

The hold zone has a first stretch characteristic while the extension or stretch zone has a second stretch characteristic. The blend zone has a mixture, combination, or blending of the first and second stretch characteristics. In an implementation, the extension zone has a greater stretch characteristic than the hold zone. And the blend zone has a stretch characteristic less than the extension zone, but greater than the hold zone.

As an example, the hold zone has about a 30 percent stretch characteristic, which means the yarn can stretch up to a length about 30 percent longer than its unstretched length. The extension second zone has about a 50 percent stretch characteristic, which results in a 20 percent differential between the hold and extension zones.

In another implementation, the hold zone has about a 40 percent stretch characteristic. The extension zone has about a 48 percent stretch characteristic. This results in an 8 percent differential between the hold and extension zones. In different implementations, a difference in stretch between the hold and extension zone can range from about 5 percent to about 60 percent. For example, the difference can be 5, 6, 7, 9, 10, 11, 12, 15, 16, 17, 18, 19, 20, 22, 23, 24, 25, 26, 27, 30, 32, 36, 38, 40, 42, 44, 45, 48, 51, 52, 55, 57, 59, or 60 percent, or other values.

The yarns used to provide stretch can include elastane or elastic polyurethane yarns or blended cotton and elastane yarns. For example, the hold zone can include elastane yarns having a first stretch characteristic, while the extension zone can include elastane yarns having the second stretch characteristic. In the blend zones, yarns having the first and second stretch characteristic are used. There are blend zones on either size of the extension zone. The blend zones blends or buffers the zones having different stretch characteristics.

Without the blend zones, there would be an abrupt or hard transition between the hold and extension zones. An abrupt transition between the hold and extension zones is undesirable because it may cause wrinkling or puckering of the fabric. With the blend zones, the fabric can remain relatively flat, despite the material having zones with two different stretch characteristics.

In an implementation, the hold zone has about a 25 percent to about 38 percent stretch characteristic, and the extension zone has a stretch characteristic from about 40 percent to about 45 percent. The stretch differential can be in a range from about 7 percent to about 15 percent, 7 percent to about 10 percent, 10 percent to about 15 percent, or other ranges.

In a specific implementation (e.g., fabric with about 55 percent cotton, 35 percent lyocell, 8 percent elastomultiester, and 2 percent elastane for the hold zone), the hold zone has about a 37.6 percent, the extension zone has about 42.2 percent stretch, and a stretch differential between the zones is about 7.6 percent. The achievable stretch differential will vary for each different fabric construction used for this technology.

In various implementations, the following are examples of an average fiber composition for an aggregate of all zones: 95 percent cotton, 5 percent elastane; a cotton-polyester blend such as 77 percent cotton, 20 percent polyester, and 3 percent elastane; 55 percent cotton, 35 percent lyocell, 8 percent elastomultiester, and 2 percent elastane; 55 percent cotton, 36 percent lyocell, 7 percent elastomultiester, and 2 percent elastane; 55 percent cotton, 37 percent lyocell, 6 percent elastomultiester, and 2 percent elastane; and 70 percent lyocell, 10 percent cotton, 8 percent polyester, and 2 percent elastane.

Lyocell can be added to a fabric (e.g., denim) to give the fabric a softer, supple handfeel. Lyocell is a man-made cellulosic fibers (e.g., lyocell, TENCEL™, modal, and others). Tencel is a trademark of Lenzing AG. Lyocell is similar to rayon or viscose and is known as regenerated cellulose fibers in the industry. Manufacturers take wood pulp, dissolve it in a chemical solvent, and then push it through an extruder to form the fibers.

Average fabric composition refers to a fabric composition of an aggregate or combination of all the zones. Also, fabric compositions are typically rounded to the nearest whole numbers. As a specific example, a multiple stretch zone fabric has a hold zone (plus half of the blend zone) of 85.25 percent of the total yardage weight and an extension zone (plus half of the blend zone) of 14.75 percent of the total yardage weight. An average fiber composition of the fabric (and garment) as an aggregate of all zones would be 55 percent cotton, 36.8525 percent lyocell, 6.1475 elastomultiester, and 2 percent elastane. This would round up to the nearest percentage to 55 percent cotton, 37 percent lyocell, 6 percent elastomultiester, and 2 percent elastane.

Therefore, the weft yarns in the extension zone would have a fabric composition with an elastane quantity that would be greater than an average of the aggregate fabric composition. The weft yarns in the hold zone would have a fabric composition with an elastane quantity that would be less than the average of the aggregate fabric composition. The extension zone yarns should have a slightly lower distribution of elastane content in the extension zone and slightly higher distribution in the hold zone to enable compression and support (e.g., especially around the thigh, right below the wearer's posterior).

As an example, for a material having 2 percent elastane content, to achieve a greater compression and hold effect, the hold zone would have a slightly higher elastane quantity (e.g., possibly 2.5 percent) with a commensurate, fractional reduction of the other fiber quantities. For the extension zone, to achieve greater extension with less lateral compression effect, the extension zone would have a slightly lower quantity of elastane (e.g., 1.5 percent) with the minor variance (e.g., 0.5 percent) spread proportionally among the other fibers.

Despite variations in elastane content, there should be equal distribution of cotton and polyester in weft yarns in the hold and extension zones. This will ensure there will not be different rates of shrinkage between the zones, which can create a visible distinction between them. The fabric should use weft yarns that had the same general distribution of fiber content, with the only material distinction being a slight variance in the quantity of elastane fiber used to create the differentiated stretch proprieties between the two zones.

Any differentiated composition between the hold yarns and extension yarns will generally create some level of visual delineation between the two functional zones. Variables beyond the control of the garment manufacturer—like consumer home laundry practices, environmental considerations like high humidity, wearing frequency, and abrasion—could all amplify the visual difference between the two zones.

Even using yarns with the same composition, where the only variable is an additional denier of elastane or slight difference in stretch or recovery performance, can lead to prominent visible distinctions after extended wearing or industrial laundry conditions. Thus, the blend zone—where the two types of weft yarn qualities are arranged in a blended gradation between the two performance zones—is used to manage the smooth transition from hold to extension zone.

Figure 4:
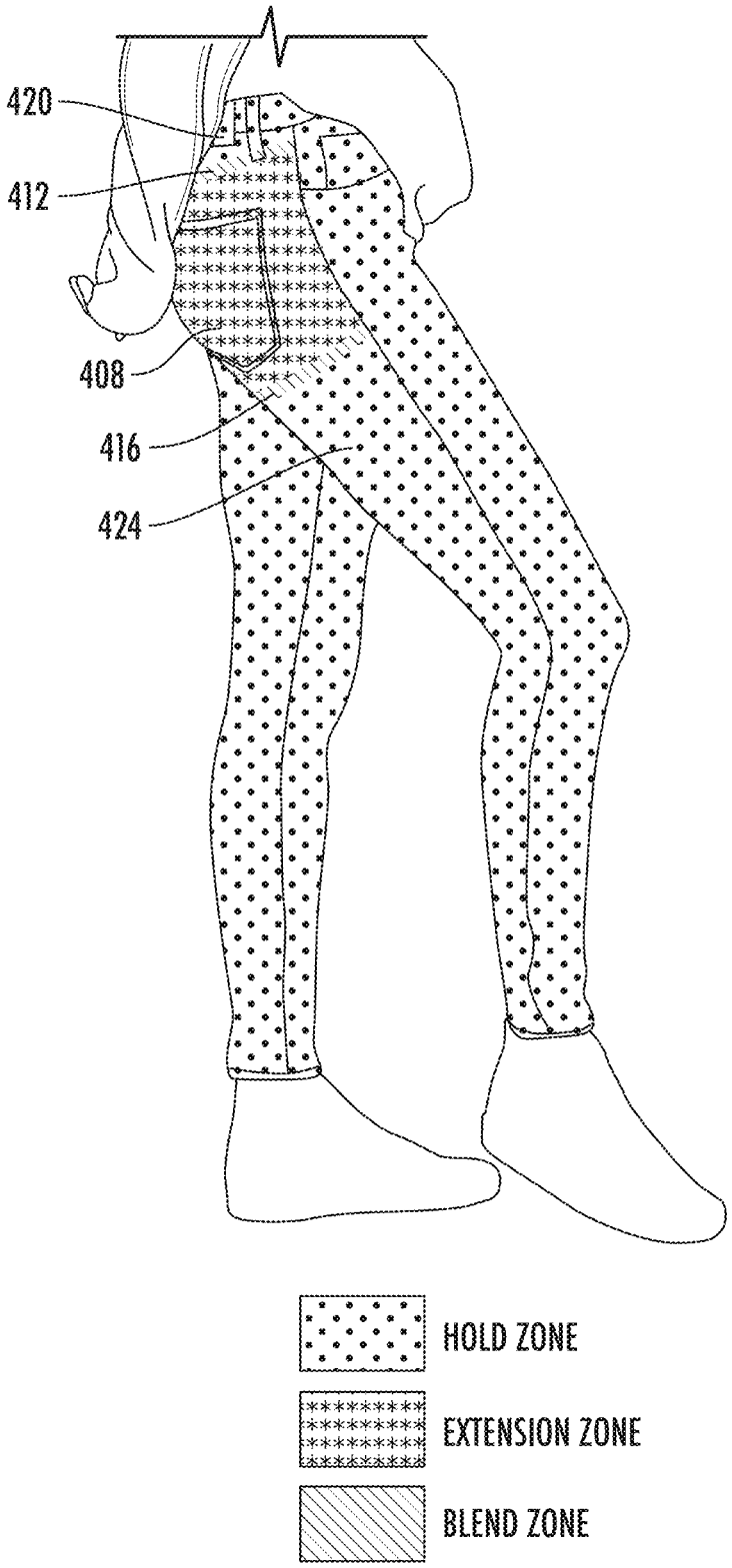
FIG. 4 shows an implementation of jeans with multiple stretch characteristics.

FIG. 4 shows an implementation of jeans with multiple stretch characteristics. The hold zone, extension zone, and blend zone are positioned as shown. The hold zone provides support, the extension zone provides stretch, and the extension zone prevents wrinkling.

In this implementation, the hold zone is used for the waist, front, thigh, and leg. The extension zone is used for the posterior only. The hold zone has stretch yarns with higher relative lateral tension force (+Ftens), engineered for compression. The extension zone has stretch yarns with relative lower relative lateral tension force (−Ftens) for easy elongation. The blend zone has a mixed gradation of hold and extension yarns to blend the transition between zones.

When the jeans are worn, the extension zone is positioned over a buttocks region 408 of the person. The extension zone can include the pocket and the fabric under the pocket. Above and below the extension zone over the buttocks region are blend zones 412 and 416. And above and below the blend zones on the posterior are hold zones 420 and 424.

The hold zone supports or squeezes the other leg, hip, or body regions. The hold and extension zones combine to sculpt and support (e.g., lift) the buttocks region to enhance its look. The enhancement may be referred to as "booty pop" or "butt pop"—where the buttocks will appear larger, firming, and more toned.

In FIG. 4, the jeans has multiple stretch characteristics. A typical women's stretch jeans will have only a single or uniform stretch characteristic, which can be up to about 10 to 20 percent stretch. For stretch jeans, the stretch characteristic will be up to about 50 percent, while maintaining an authentic jeans look. Greater stretch is possible, such as 70 percent, which are more typical of yoga pants.

Figure 5:
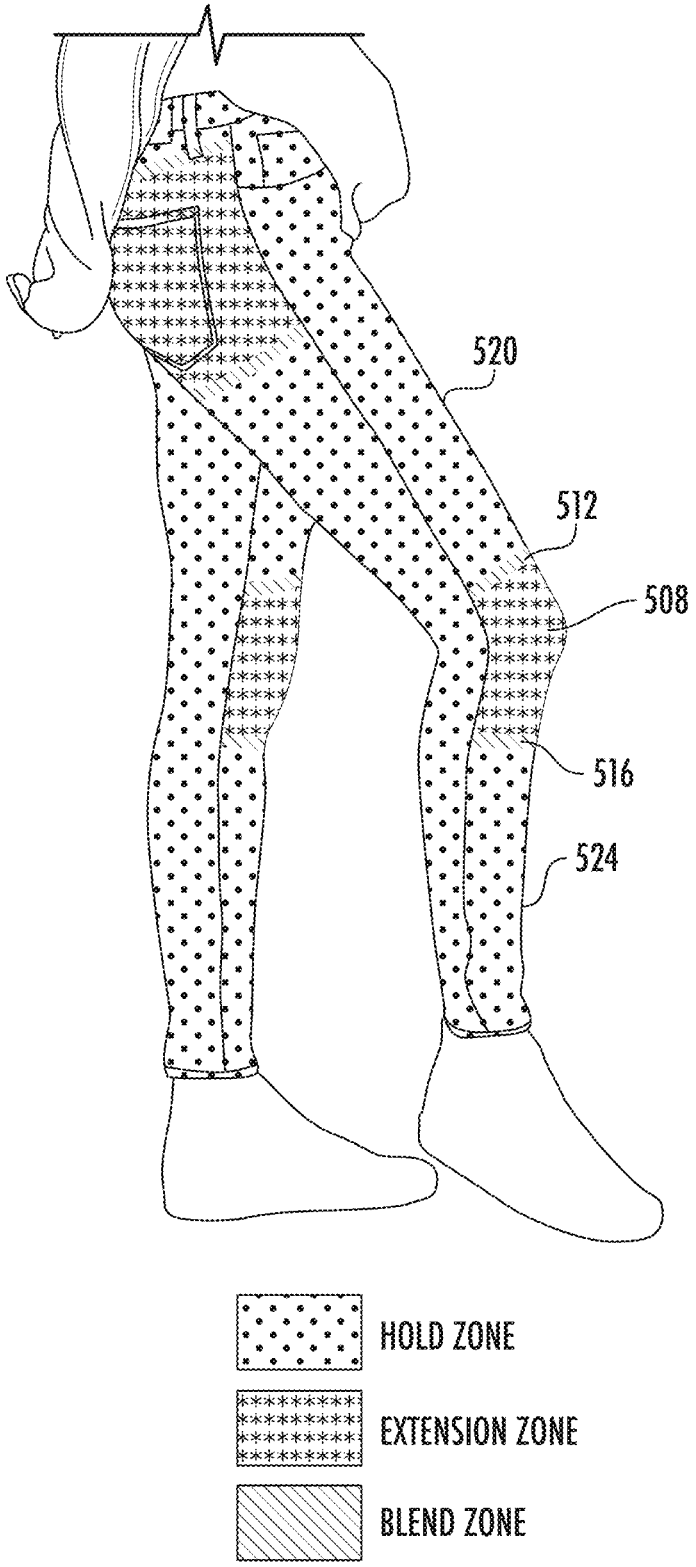
FIG. 5 shows another implementation of jeans with multiple stretch characteristics.

FIG. 5 shows another implementation of jeans with multiple stretch characteristics. Compared to the FIG. 4 implementation, the extension zone is also used for the knee caps—an anterior of the jeans.

In this implementation, the hold zone is used for the waist, front, thigh, and leg. The extension zone is used for the posterior and anterior, knee cap regions 508. Above and below the extension zone over the knee cap regions are blend zones 512 and 516. And above and below the blend zones on the anterior are hold zones 520 and 524.

The hold zone has stretch yarns with higher relative lateral tension force (+Ftens), engineered for compression. The extension zone has stretch yarns with relative lower relative lateral tension force (−Ftens) for easy elongation. The blend zone has a mixed gradation of hold and extension yarns to blend the transition between zones.

Figure 6:
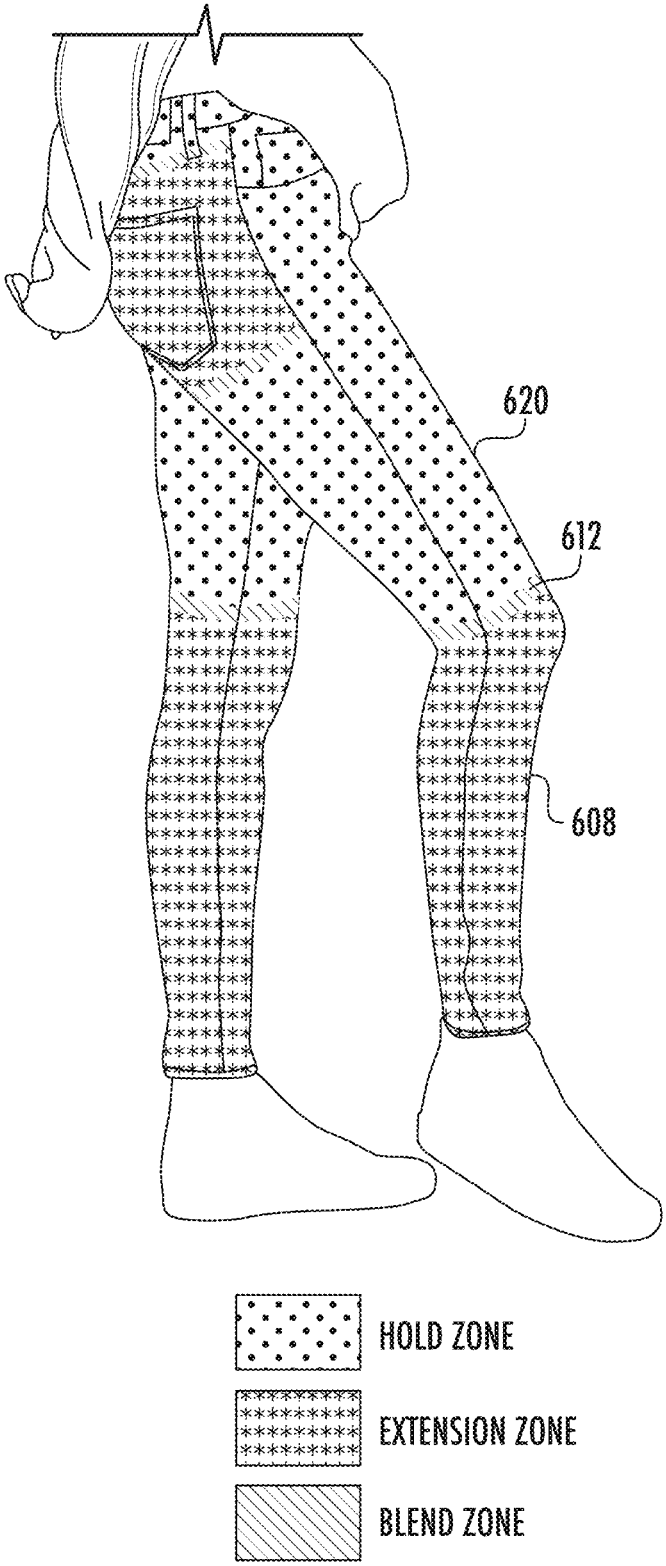
FIG. 6 shows another implementation of jeans with multiple stretch characteristics.

FIG. 6 shows another implementation of jeans with multiple stretch characteristics. Compared to the FIG. 4 implementation, the extension zone is used for just above the knee and down, both the back and front of the leg.

In this implementation, the hold zone is used for the front and thigh. The extension zone is used for the waist, posterior, knees, and calves. The knee and calf regions including anterior and posterior sections.

The extension zone is used for the knee and calf regions 608, anterior and posterior portions of the jeans. The knee and calf regions extend from the knee cap to the bottom edge of the jeans. Above the extension zone over the knee and calf regions are blend zones 612. And above the blend zones are hold zones 620.

The hold zone has stretch yarns with higher relative lateral tension force (+Ftens), engineered for compression. The extension zone has stretch yarns with relative lower relative lateral tension force (−Ftens) for easy elongation. The blend zone has a mixed gradation of hold and extension yarns to blend the transition between zones.

Figure 7:
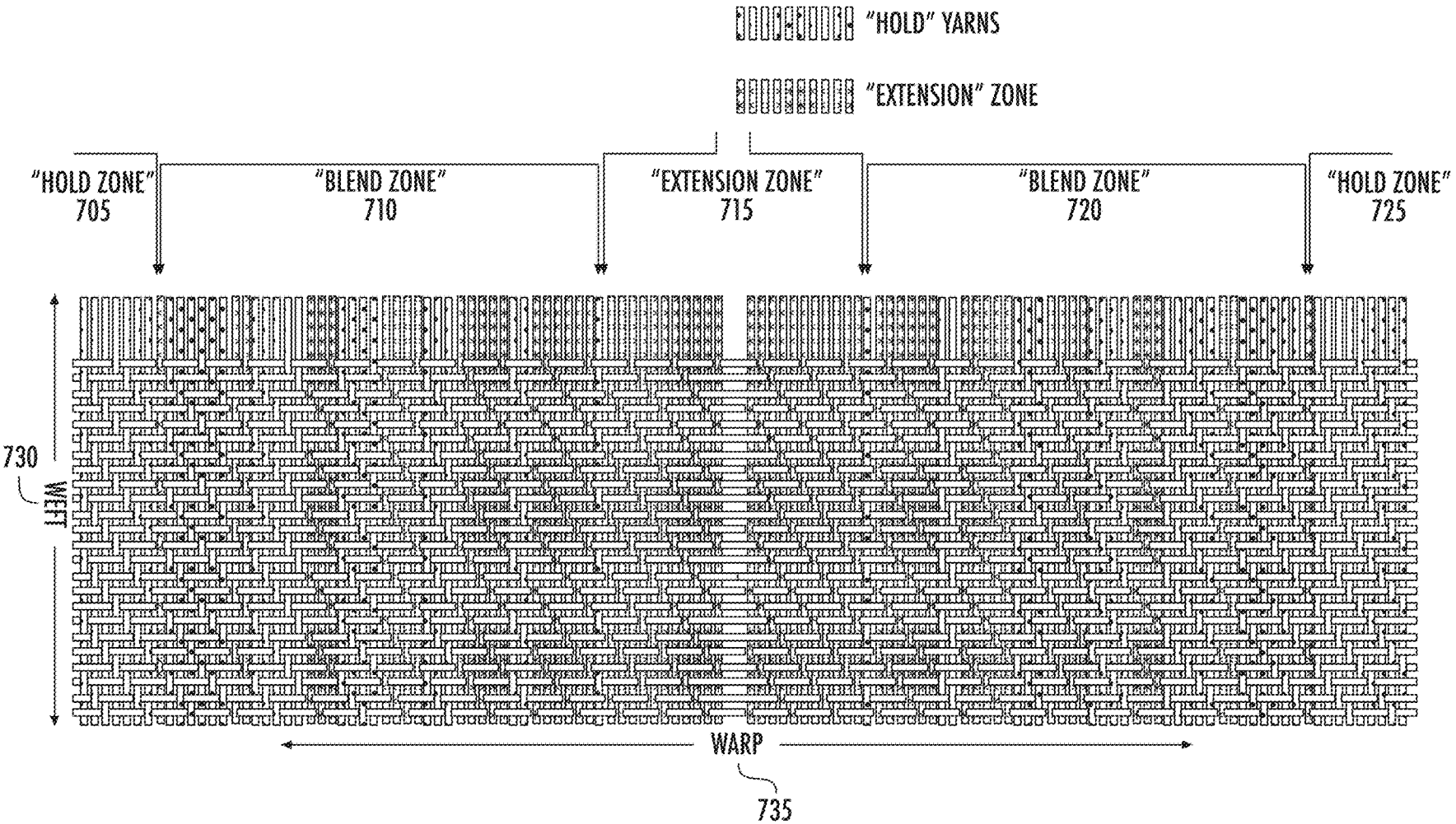
FIG. 7 shows details of a weave of a fabric with multiple stretch characteristics.

FIG. 7 shows details of a weave of a fabric with multiple stretch characteristics. There is a hold zone 705, blend zone 710, extension zone 715, blend zone 720 and hold zone 725. The warp yarns are in a direction 735, and the weft yarns are in a direction 730.

In an implementation, the hold yarns are stretch yarns with higher relative lateral tension force (+Ftens), engineered for compression with 100 percent recovery. The extension yarns are are stretch yarns with relative lower relative lateral tension force (−Ftens), engineered for easy elongation with 100 percent recovery.

The blend zone is roughly about 1 inch in length and includes a blended gradation of extensions yarns and hold yarns. The blend zone has alternating groupings of extensions yarns and hold yarns. In a specific implementation, there are 42 weft ends for a 1-inch width. In the blend zone, there will be 1 extension yarn, then 6 hold yarns, then 2 extension yarns, then 5 hold yarns, then 3 extension yarns, then 4 hold yarns, 4 extension yarns, 3 hold yarns, 5 extension yarns, 2 hold yarns, 6 extension yarns, and 1 hold yarn. The width is about 1 inch and determined by the yarn gauge and count.

In other implementations, for example, the blend zone can be 2 inches, while having the same alternating groupings of extensions yarns and hold yarns. This can be due to the yarn size used in the weft to be somewhat larger, which increases the overall width of the blend zone. In other implementations, there can be other alternating groupings of extensions yarns and hold yarns.

Figure 8:
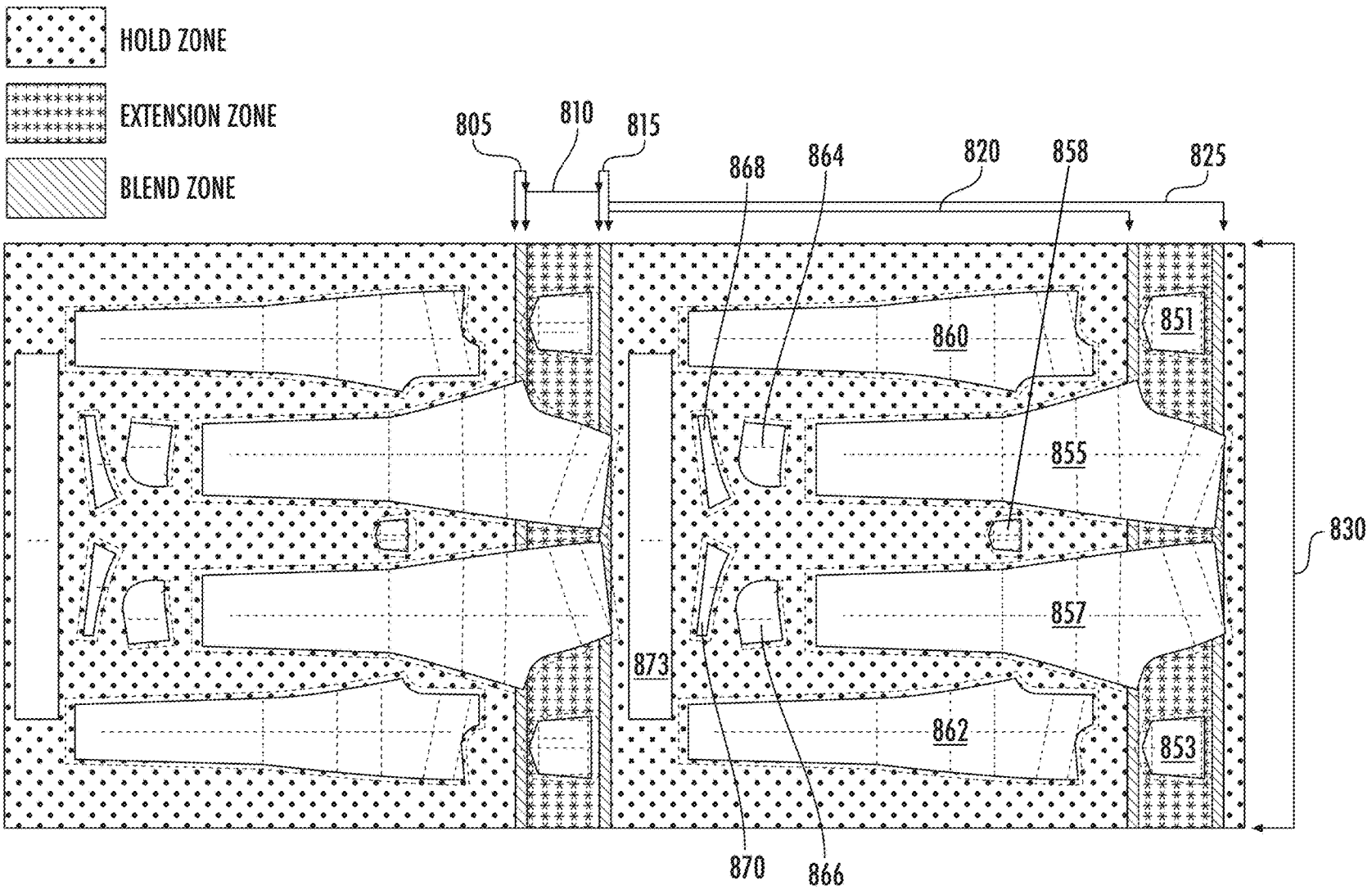
FIGS. 8-12 show pattern or panel placements on a material with multiple stretch characteristics for different jeans implementations.
Figure 9:
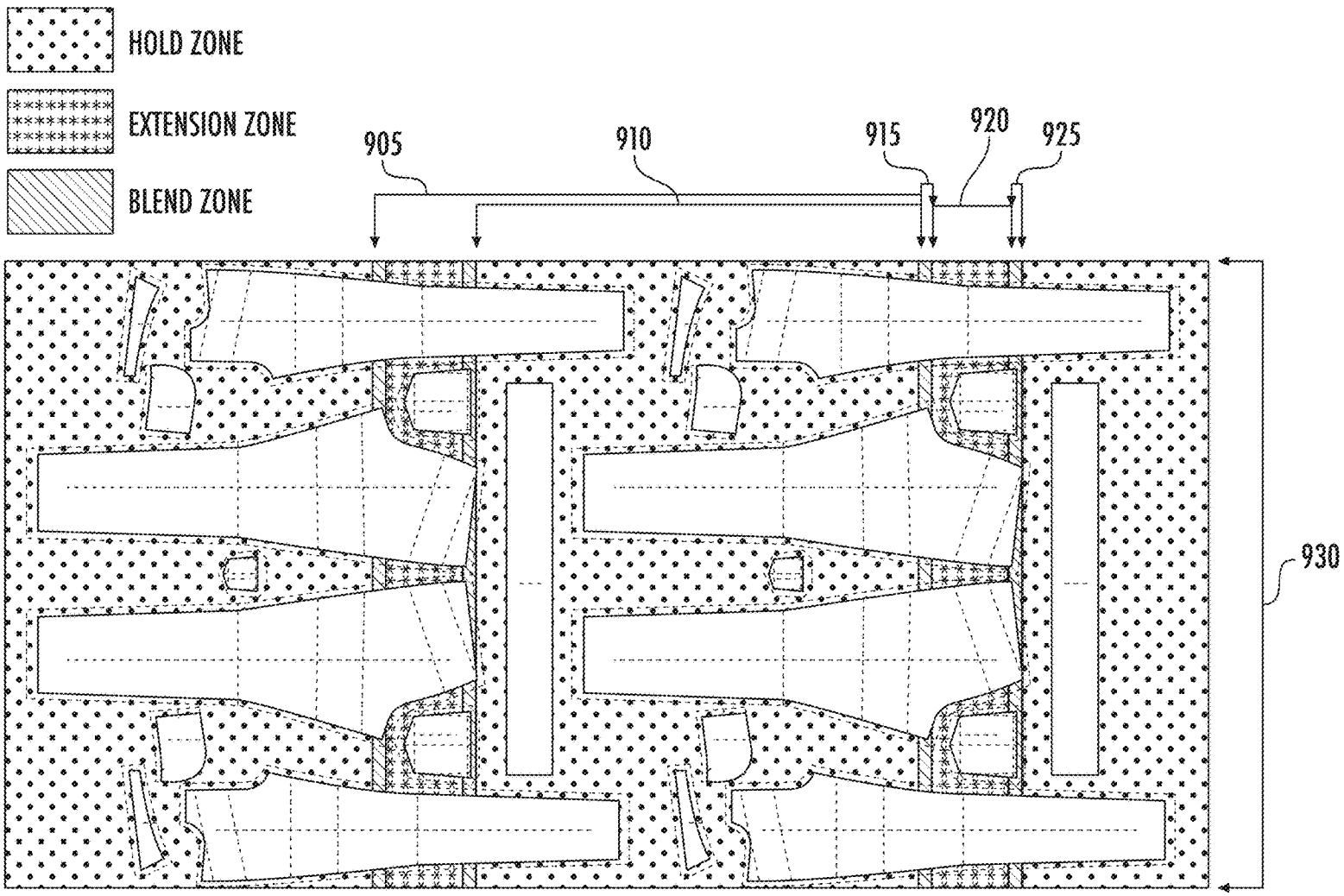
Figure 10:
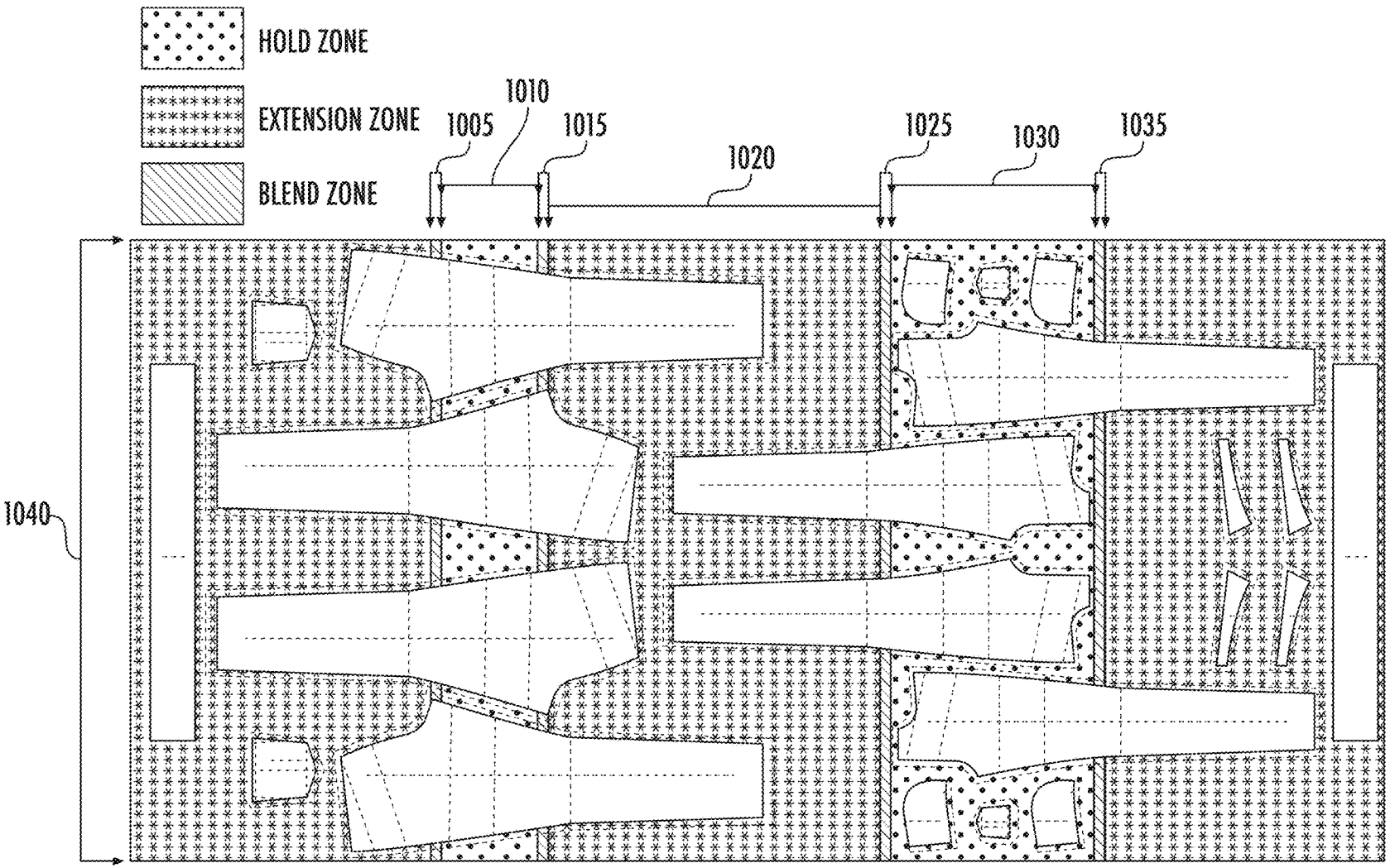
Figure 11:
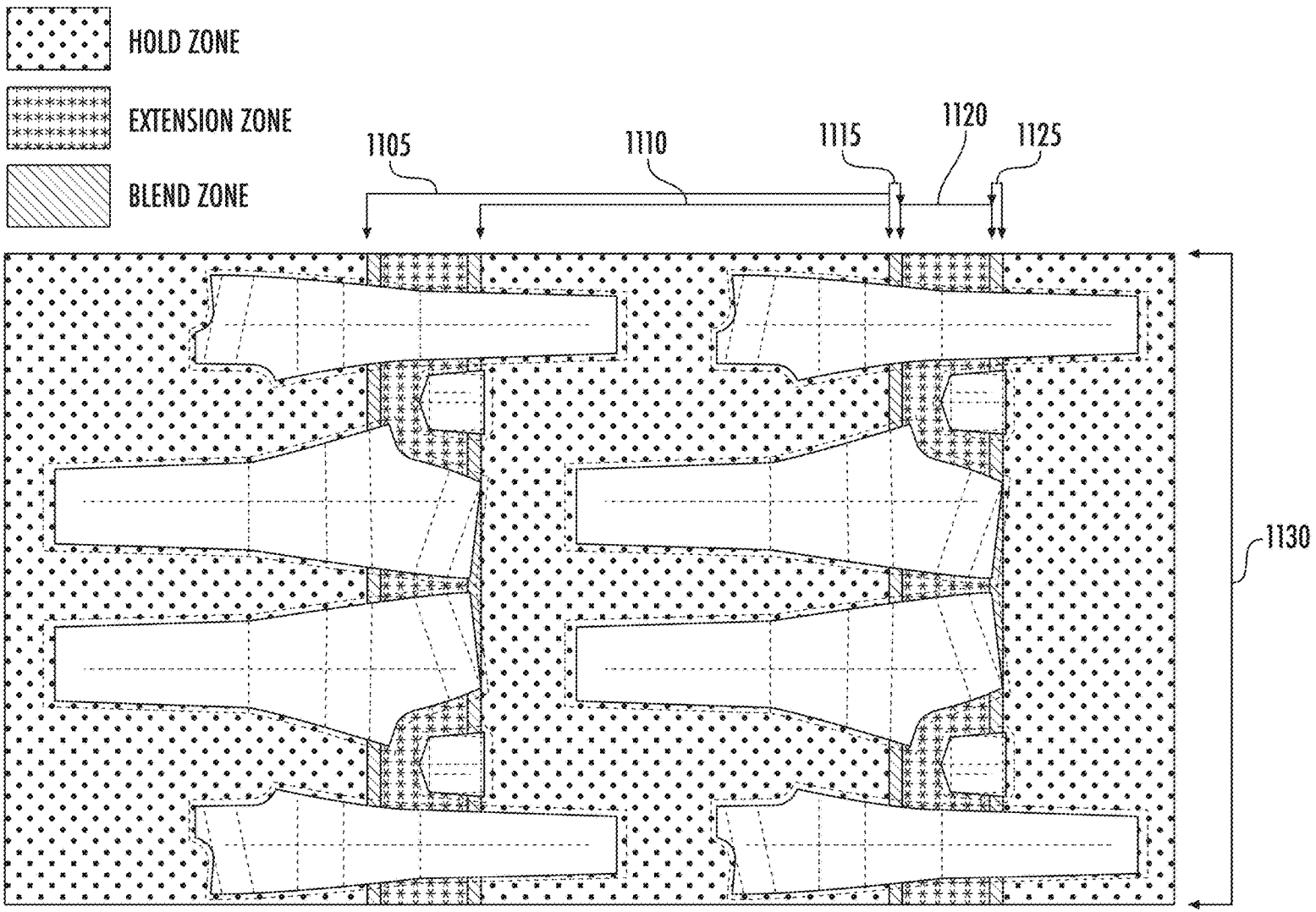
Figure 12:
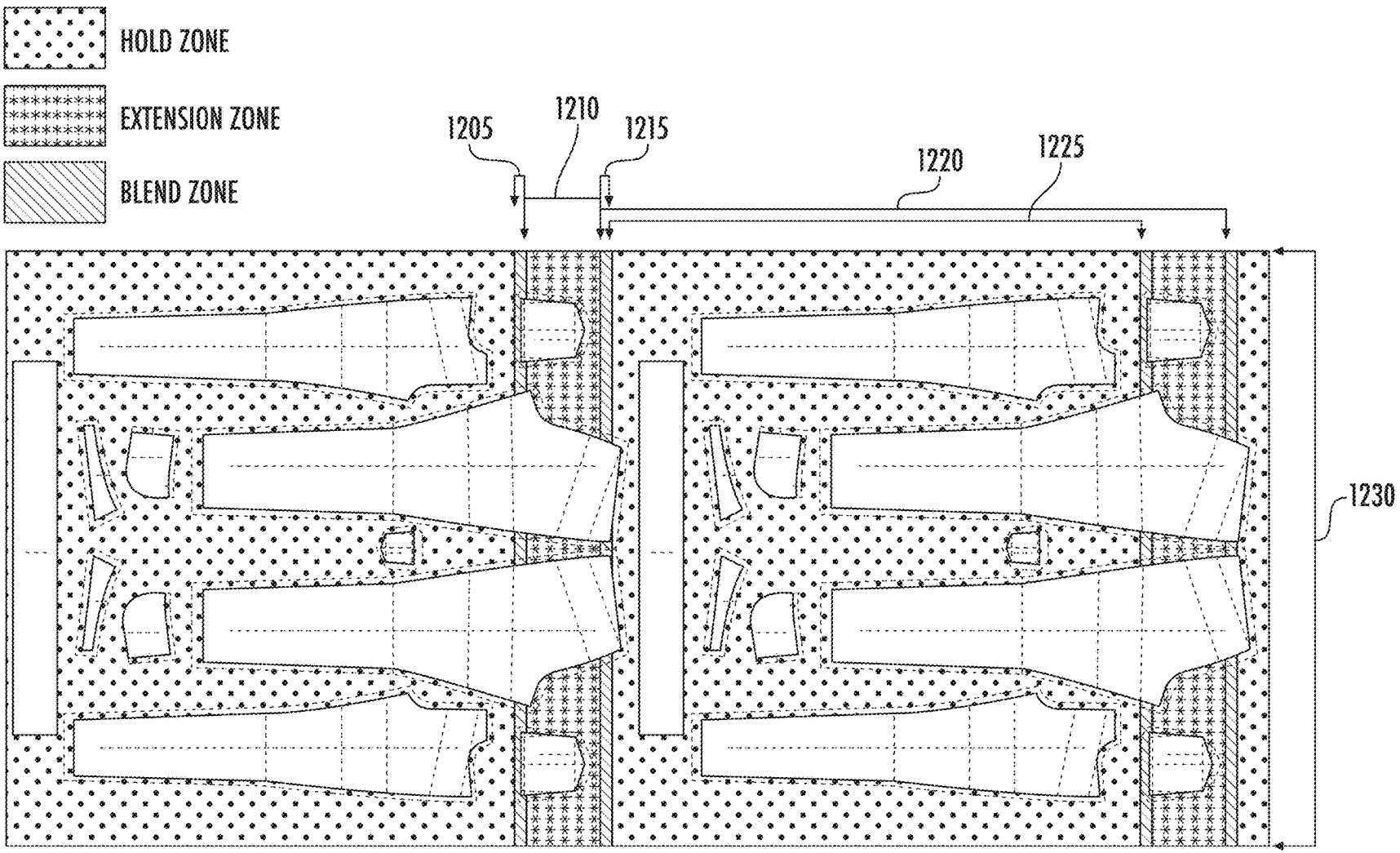

FIGS. 8-12 show pattern or panel placements on a material with multiple stretch characteristics for different jeans implementations. FIG. 8 shows pattern or panel placement on yardage for the jeans implementation of FIG. 4. FIG. 9 shows pattern or panel placement on yardage for the jeans implementation of FIG. 5. FIG. 10 shows pattern or panel placement on yardage for the jeans implementation of FIG. 5. FIGS. 11-12 are pattern or panel placements for yardage for other implementations.

FIG. 8 shows a pattern placement implementation where the hold zone is used for the waist, front, thigh, and leg. The extension zone is used for the posterior only. There is a 1-inch blend zone 805, 7-inch extension zone 810, 1-inch blend zone 815, 50-inch hold zone 820, 59-inch engineered repeat (total) 825, and 54-inch cuttable width (estimate) 830. The patterns or panels are placed are positioned in the various zones as shown.

The pattern panels are as follows: a back pocket, left 851, back pocket, right 853; back leg, left 855; back leg, right 857; coin pocket 858, front leg, left 860; front leg, right 862; front pocket facing, left 864; front pocket facing, right 866; back yoke, left 868; back yoke, right 870; and waistband 873.

FIG. 9 shows a pattern placement implementation where the hold zone is used for the waist, front, thigh, and leg. The extension zone is used for the posterior and knee. There is a 49-inch engineered repeat (total) 905, 40-inch hold zone 910, 1-inch blend zone 915, 7-inch extension zone 920, 1-inch blend zone 925, and 54-inch cuttable width (estimate) 930. The patterns or panels are placed are positioned in the various zones as shown.

FIG. 10 shows a pattern placement implementation the hold zone is used for the front and thigh. The extension zone is used for the waist, posterior, knees, and calves. There is a 1-inch blend zone 1005, 9-inch hold zone 1010, 1-inch blend zone 1015, 31-inch extension zone 1020, 1-inch blend zone 1025, 19-inch hold zone 1030, 1-inch blend zone 1035, and 56-inch cuttable width (estimate) 1040. There is a 116-inch engineered repeat (total). The patterns or panels are placed are positioned in the various zones as shown.

FIG. 11 shows a pattern placement implementation where the hold zone is used for the waist, front, thigh, and leg. The extension zone is used for the posterior and knee. There is a 49-inch engineered repeat (total) 1105, 36-inch hold zone 1110, 1-inch blend zone 1115, 8-inch extension zone 1120, 1-inch blend zone 1125, and 54-inch cuttable width (estimate) 1130. The patterns or panels are placed are positioned in the various zones as shown.

FIG. 12 shows a pattern placement implementation where the hold zone is used for the waist, front, thigh, and leg. The extension zone is used for the posterior only. There is a 1-inch blend zone 1205, 7-inch extension zone 1210, 1-inch blend zone 1215, 59-inch engineered repeat (total) 1220, 50-inch hold zone 1225, and 54-inch cuttable width (estimate) 1230. The patterns or panels are placed are positioned in the various zones as shown.

In a further implementation, a weaving pattern has a 48-inch hold zone, 2-inch blend zone, 7-inch extensions zone, 2-inch blend zone, and then repeats. The exact lengths of the different zones can vary based on for example, the yarn gauge and count, as well as the garment being produced. For example, children's clothing will have generally shorter lengths for the extension and hold zones, while the blend zone length can remain the same. Plus-size and extra-tall clothing can have longer lengths for the extension and hold zones, while the blend zone length can remain the same.

Figure 14:
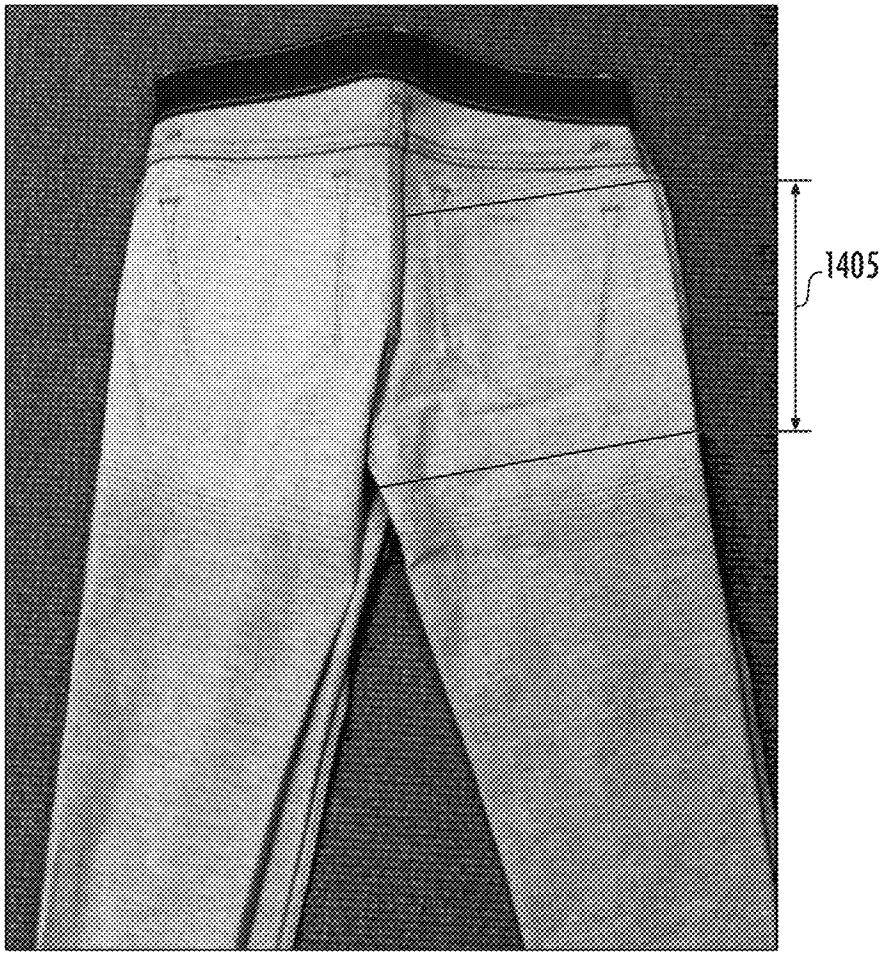
FIGS. 13-14 show photographs of jeans made from fabric having two different stretch characteristics.
Figure 13:
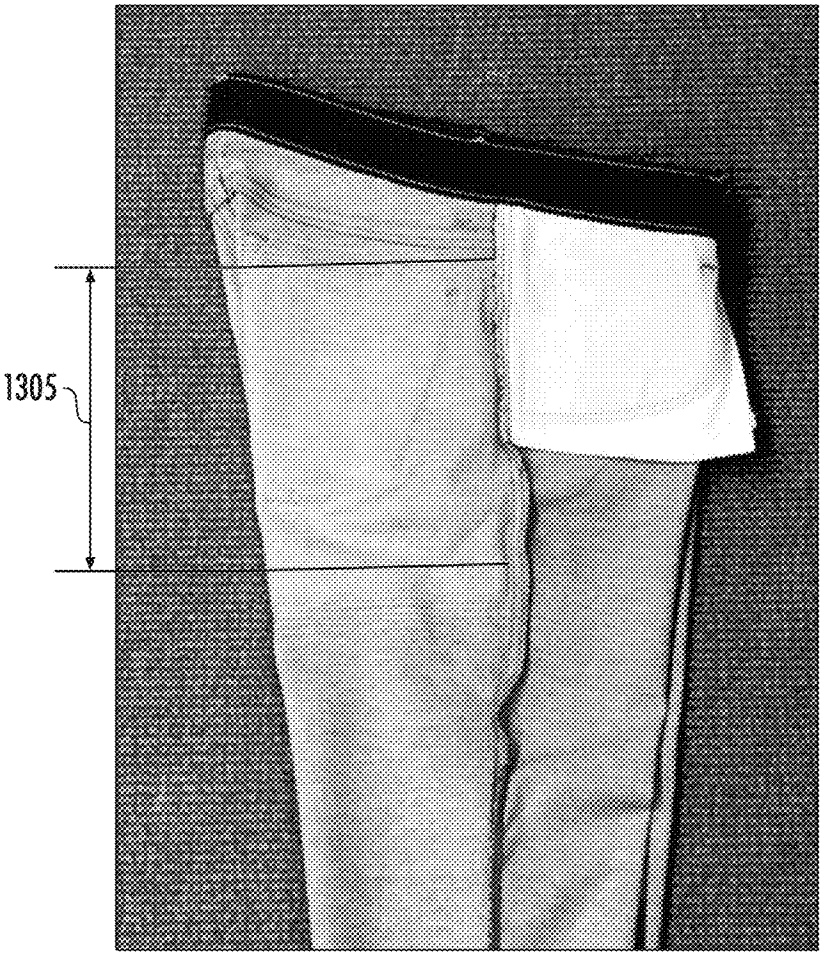

FIGS. 13-14 show photographs of jeans made from fabric having two different stretch characteristics. FIG. 13 shows a garment side view, inside out. FIG. 14 shows a garment back view, inside out. In this jeans implementation, the hold zone is used for the waist, front, thigh, and leg. The extension zone is used for the posterior only.

The photographs show a positioning of an extension zone 1305 and extension zone 1405. To allow seeing the different stretch yarns in this jeans sample, the hold zone yarns have been dyed a different color from the extension zone yarns to allow a person to see the various zones. The hold zone yarns are a darker color than the extension zone yarns. The blend zones are shown with alternating color bands, indicating the alternating hold and extension yarns.

In a first implementation type, as reflected in FIGS. 4, 8, 12, and 13-14 (and also FIGS. 15-16 below), jeans or pants are primarily made from the hold zone material, while the extension zone is only at the wearer's posterior or buttocks region. Either the pattern placements in FIG. 8 or 12 can be used for the first implementation type of jeans.

A difference between the two placements is that for the pattern placement of FIG. 12, the top edge seam allowance of the back pocket extends into the blend zone as a mechanism to stabilize the pocket opening. The top edge of the back pocket pattern includes roughly 1 inch of extra material that is folded over twice and sewn with a double-needle topstitch to create a half-inch rolled hem at the pocket opening top edge.

On very high stretch fabrics (e.g., like the extension zone) the sewing process itself stretches the fabric slightly, and the double-needle stitching of the rolled hem holds the fabric slightly extended. By placing the fold line of the back pocket hem allowance on the edge of the extension and blend zones—using blend zone fabric for the rolled hem allowance—the slightly higher lateral tension force helps the top edge of the pocket recover its shape (after being slightly stretched by the sewing process) and remain flush and flat against the back leg of the jean.

In an implementation, the distance from the fold line (top edge of finished pocket) to the cut edge of the fabric is about three-quarters of an inch or about 0.75 inches. This measurement and the pocket's placement can remain consistent across all sizes of garment; the fold line would be placed on or relatively close to the edge between the extension and blend zones. For the outside surface of the pocket, this material would be hold zone material, while an inside surface (inside the pocket) for the rolled hem would be blend zone material.

In a second implementation type, as reflected in FIGS. 5, 9, and 11, jeans or pants are also primarily made from hold zone material, while the extension zone is at the wearer's posterior or buttocks region and also the front knee region.

In a third implementation type, as reflected in FIGS. 6 and 10, jeans or pants are primarily made from extension zone material, while the hold zone placement is around the wearer's thigh and stomach regions.

Figure 15:
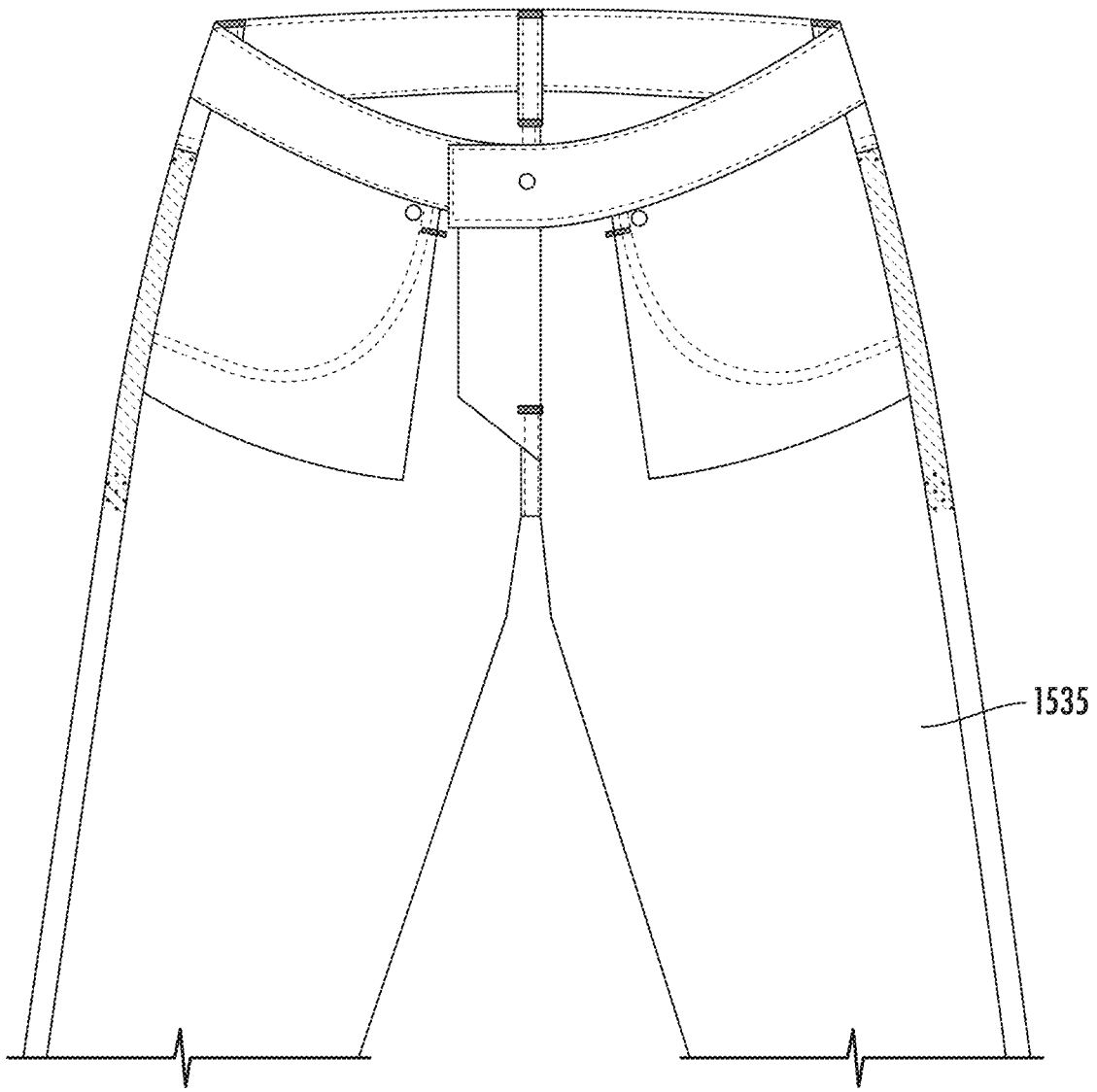
FIGS. 15-16 show a specific implementation of a pair of jeans with at least two different stretch characteristics for a posterior of the jeans.
Figure 16:
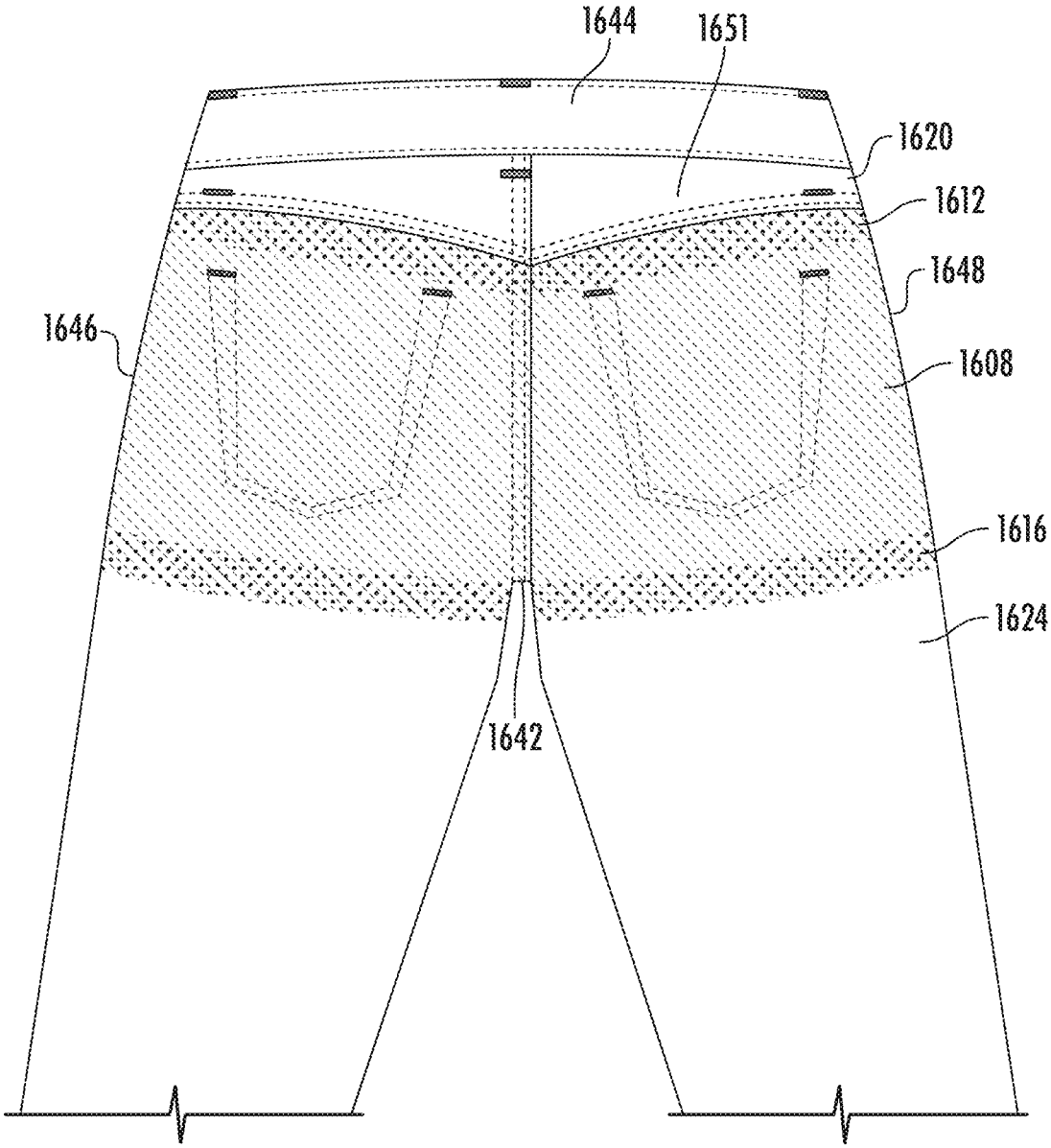

FIGS. 15-16 show a specific implementation of a pair of jeans or pants with at least two different stretch characteristics for a posterior of the jeans, where the buttocks region is covered by an extension zone to give more stretch. FIG. 15 shows an anterior of the jeans, inside-out. FIG. 16 shows a posterior of the jeans, inside-out. For the posterior, the jeans have an extension or stretch zone 1608. Above and below the extension zone are blend zones 1612 and 1616. Above and below the blend zones are hold zones 1620 and 1624. In an implementation, the anterior 1535 of the jeans is made entirely of hold zone material.

In FIG. 15, the view of the anterior of pants has mostly hold zone material, except at slightly forward showing side seams. A small amount of the extension and hold zones show at the side seams, where the back panel and yoke meet an outseam.

The outseam is the outer length of the pants, measured from the top of the waistband, down the side to the bottom of the hem. The inseam is the inner length of the pants, measured from the point in the crotch where both leg seams meet down the inner seam of the leg to the bottom of the hem In FIG. 16, the extension zone is positioned to start at a crotch point 1642 of the jeans and extend upward (e.g., vertically) toward a waistband 1644. The extension zone extends (e.g., horizontally) from a first edge 1646 to a second edge 1648. The extension zone and blend zone of the seat or buttocks region of the jeans are below a yoke 1651.

Figure 17:
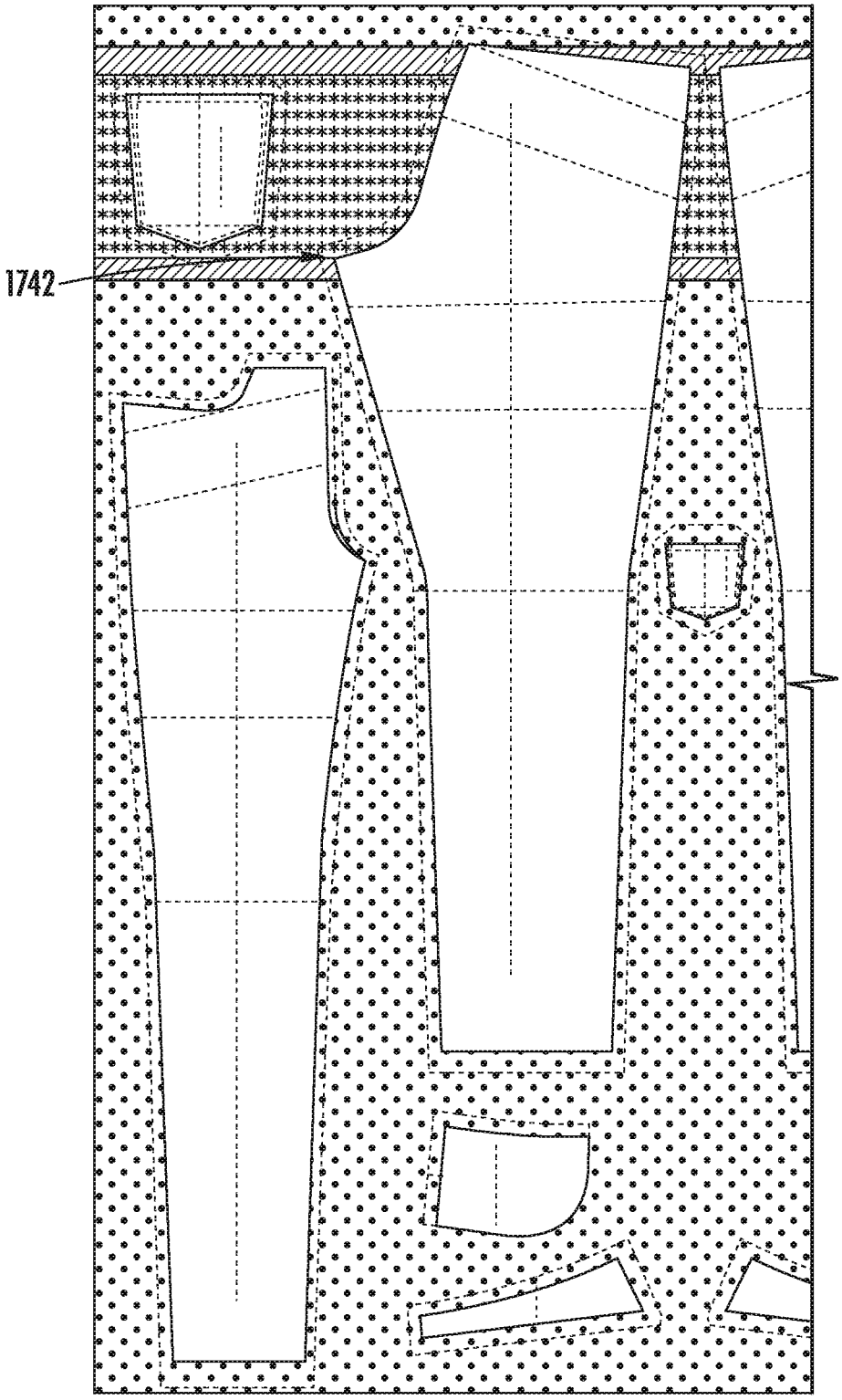
FIG. 17 shows a portion of a pattern or panel placement on material with a positioning of a crotch point relative to the extension, blend, and hold zones.

FIG. 17 shows a portion of a pattern or panel placement on material with a positioning of a crotch point 1742 relative to the extension, blend, and hold zones. In an implementation, the back leg panel is placed on the material or fabric on grain, balanced parallel to the edge of the fabric or selvage (e.g., for self-edged denim) with crotch point 1742 placed at a point where a bottom edge of the extension zone meets the blend zone.

A selvage or selvedge is a "self-finished" edge of fabric, keeping it from unraveling and fraying. Self-finished means the edge does not require additional finishing work (e.g., hem, bias tape, overlock stitch, zig-zag stitch, or overcast stitch) to prevent fraying.

In an implementation, slight deviations in blend zone length (e.g., less than 1 inch) caused by changes in the base fabric quality do not affect how any of the pattern pieces are placed on the fabric for cutting and do not impact where the extension zone is placed or how patterns are placed. The crotch point of back leg continues to be placed on lower edge of extension zone and blend zone.

The blend zone is adjacent to extension zone, above and below. For the blend zone below the extension zone, this lower blend zone starts at the crotch point and a lower edge of the extension zone and extends toward the jeans bottom a first blend distance. For the blend zone above the extension zone, this upper blend zone starts at an upper edge of the extension zone and extends toward the jeans waist edge a second blend distance. In an implementation, the upper blend zone ends at a yoke seam, where a back leg panel is joined to a yoke panel of the jeans. The yoke panel is made from hold zone material.

More specifically, the bottom edge of the hold zone (illustrated with diagonal dashed lines) is anchored to the crotch point for all sizes and extends up. The lower blend zone (illustrated with diagonal dashed lines and horizontal dotted lines) extends down from the crotch point. The placement for the top edge of the extension zone relative to other fixed points on the garment will vary slightly between sizes, and the upper blend zone will extend into the back yoke seam as shown. The back pockets—not shown on this interior figure, but shown in FIGS. 8-9 and 11-13, are placed on the extension zone fabric for cutting. The rest of the garment—represented in white—is placed and cut from hold zone fabric.

In an implementation, the first blend distance is the same as the second blend distance, but in other implementations, the distances are different. In an implementation, the blend zone distance is about 1 inch, but can be other values in other implementations. The length of the blend zone can vary based on, for example, yarn gauge and count—even given the same alternating groupings of extensions yarns and hold yarns (e.g., such as specific alternating groupings elsewhere in this application).

For example, the blend zone length can be 0.25 inches to 1 inch, 0.5 inches to 1 inch, 0.75 inches to 1 inch, less than 1 inch, greater than 1 inch, 1 to 1.25 inches, 1 to 1.5 inches, 1 to 1.75 inches, 1 to 2 inches, 1.5 to 2.5 inches, 0.75 to 2.25 inches, 0.75 to 2.5 inches, 0.75 to 3 inches, 1.5 inches or more, 2 inches or more, or others. The blend zone should have sufficient length or distance so that there will be no visible difference between the extension zone and hold zone when viewed from an exterior of the jeans. For example, the jeans will lay relatively flat, uniform, and even (e.g., without visible crinkling, craping, puckering, wrinkling, or other signs of unevenness) between the regions when laying on a surface or hung on a hanger, even after laundering (e.g., machine washing and drying).

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

The invention claimed is:

1. A method comprising:

providing a first panel of contiguously woven fabric for a pair of pants, wherein the first panel comprises a first region comprising a first yarn having a first stretch characteristic, a second region comprising a second yarn having a second stretch characteristic, and a third region comprising a blend of the first yarn and the second yarn;

positioning the first region of the first panel at an extension location of the pants;

positioning the second region below the extension location, wherein the first stretch characteristic is greater than the second stretch characteristic;

positioning the third region between the first and second regions, wherein the third region smoothly transitions from the first region to the second region to avoid forming of an abrupt transition edge; and positioning a crotch point of the pants along an edge where the first region meets the third region of the first panel, wherein the blend of the first yarn and the second yarn in the third region is made by weaving 1 first yarn, then 6 second yarns, then 2 first yarns, then 5 second yarns, then 3 first yarns, then 4 second yarns, 4 first yarns, 3 second yarns, 5 first yarns, 2 second yarns, 6 first yarns, and 1 second yarn.

2. The method of claim 1 wherein the extension location is at a buttocks region of the pants.

3. The method of claim 1 wherein the extension location is at a knee cap region of the pants.

4. The method of claim 1 comprising:

providing a second panel for a back pocket of the pants, wherein the second panel comprises a first pocket region comprising the second yarn having the second stretch characteristic, and a second pocket region comprising a blend of the first yarn and the second yarn; and positioning a first portion of a rolled hem of the back pocket in the first pocket region and a second portion of the rolled hem of the back pocket in the second pocket region.

5. The method of claim 1 wherein the contiguously woven fabric for pants comprises a plurality of warp yarns that contiguously weave through weft yarns of the first region, second region, and third region.

6. The method of claim 1 comprising:

for the first yarn, using a yarn having a first percentage of elastane; and for the second yarn, using a yarn having a second percentage of elastane, wherein the second percentage is greater than the first percentage.

7. The method of claim 1 wherein the first stretch characteristic comprises more elongation and less compression relative to the second stretch characteristic, and the second stretch characteristic comprises less elongation and greater compression relative to the first stretch characteristic.

* * * * *